US010839734B2

(12) United States Patent
Adamovich et al.

(10) Patent No.: US 10,839,734 B2
(45) Date of Patent: Nov. 17, 2020

(54) OLED COLOR TUNING BY DRIVING MODE VARIATION

(71) Applicant: Universal Display Corporation, Ewing, NJ (US)

(72) Inventors: Vadim Adamovich, Yardley, PA (US); Lech Michalski, Pennington, NJ (US); Michael Stuart Weaver, Princeton, NJ (US); Michael O'Connor, Ewing, NJ (US)

(73) Assignee: Universal Display Corporation, Ewing, NJ (US)

( * ) Notice: Subject to any disclaimer, the term of this patent is extended or adjusted under 35 U.S.C. 154(b) by 721 days.

(21) Appl. No.: 14/573,762

(22) Filed: Dec. 17, 2014

(65) Prior Publication Data

US 2015/0213747 A1 Jul. 30, 2015

Related U.S. Application Data

(60) Provisional application No. 61/919,937, filed on Dec. 23, 2013.

(51) Int. Cl.

| | |
|---|---|
| ***G09G 3/3275*** | (2016.01) |
| ***G09G 3/20*** | (2006.01) |
| ***G09G 3/3225*** | (2016.01) |

(52) U.S. Cl.

CPC ..... *G09G 3/2003* (2013.01); *G09G 3/3225* (2013.01); *G09G 3/3275* (2013.01); *G09G 3/2081* (2013.01); *G09G 2320/0242* (2013.01); *G09G 2320/043* (2013.01); *G09G 2320/045* (2013.01); *G09G 2320/0666* (2013.01)

(58) Field of Classification Search

None

See application file for complete search history.

(56) References Cited

U.S. PATENT DOCUMENTS

| | | | |
|---|---|---|---|
| 4,769,292 | A | 9/1988 | Tang et al. |
| 5,247,190 | A | 9/1993 | Friend et al. |
| 5,703,436 | A | 12/1997 | Forrest et al. |

(Continued)

FOREIGN PATENT DOCUMENTS

| | | | |
|---|---|---|---|
| CN | 1372432 | A | 10/2002 |
| CN | 101430862 | A | 5/2009 |

(Continued)

OTHER PUBLICATIONS

Baldo, et al., "Highly efficient phosphorescent emission from organic electroluminescent devices", Nature, vol. 395, pp. 151-154, 1998.

(Continued)

*Primary Examiner* — William Boddie
*Assistant Examiner* — Bipin Gyawali
(74) *Attorney, Agent, or Firm* — Butzel Long

(57) ABSTRACT

Techniques, devices, and systems are provided that allow for driving a device such as an OLED in various pulsed modes in which a momentary luminance greater than an apparent luminance at which the OLED is to be driven is used. The use of one or more pulsed modes allows for the lifetime of the OLED to be extended and reduces image sticking. Pulsed modes are also provided that allow for color tuning of the device by activating different portions of one or more emissive areas of the device.

20 Claims, 39 Drawing Sheets

(56) References Cited

U.S. PATENT DOCUMENTS 5,707,745 A 1/1998 Forrest et al.
5,834,893 A 11/1998 Bulovic et al.
5,844,363 A 12/1998 Gu et al.
6,013,982 A 1/2000 Thompson et al.
6,087,196 A 7/2000 Sturm et al.
6,091,195 A 7/2000 Forrest et al.
6,097,147 A 8/2000 Baldo et al.
6,294,398 B1 9/2001 Kim et al.
6,303,238 B1 10/2001 Thompson et al.
6,337,102 B1 1/2002 Forrest et al.
6,468,819 B1 10/2002 Kim et al.
6,498,438 B1 * 12/2002 Edwards ..... G09G 3/325 313/504
6,501,230 B1 * 12/2002 Feldman ..... H05B 45/60 315/169.3
7,088,051 B1 * 8/2006 Cok ..... G09G 3/3233 315/169.1
7,250,928 B2 * 7/2007 Yamazaki ..... G09G 3/3241 315/169.3
7,279,704 B2 10/2007 Walters et al.
7,431,968 B1 10/2008 Shtein et al.
7,675,493 B2 * 3/2010 Yoon ..... G09G 3/3233 345/76
7,968,146 B2 6/2011 Wagner et al.
8,077,123 B2 * 12/2011 Naugler, Jr. ..... G09G 3/3233 315/169.3
8,120,555 B2 * 2/2012 Cok ..... G09G 3/3233 345/204
8,570,314 B2 * 10/2013 Hasegawa ..... G09G 3/3225 345/205
2003/0007438 A1 * 1/2003 Kim ..... G11B 7/0045 369/53.26
2003/0230980 A1 12/2003 Forrest et al.
2004/0174116 A1 9/2004 Lu et al.
2004/0184378 A1 * 9/2004 Kwon ..... G11B 7/00456 369/53.26
2005/0007304 A1 * 1/2005 Gallagher ..... H05B 45/327 345/30
2005/0088379 A1 * 4/2005 Tsuchida ..... G09G 3/3291 345/76
2005/0168417 A1 * 8/2005 Ha ..... G09G 3/3291 345/76
2005/0280766 A1 * 12/2005 Johnson ..... G09G 3/3225 349/167
2006/0125408 A1 * 6/2006 Nathan ..... G09G 3/3241 315/169.3
2009/0121642 A1 * 5/2009 Ceballos ..... G09G 3/3258 315/209 T
2010/0013746 A1 * 1/2010 Seto ..... G09G 3/3233 345/76
2010/0073265 A1 * 3/2010 Hirai ..... G09G 3/3283 345/55
2011/0080441 A1 * 4/2011 Wacyk ..... G09G 3/2081 345/691
2011/0169024 A1 * 7/2011 Verschuren ..... H01L 51/5036 257/89
2012/0050280 A1 * 3/2012 Kim ..... G09G 3/3648 345/419
2013/0285537 A1 * 10/2013 Chaji ..... H01L 27/322 313/504
2013/0321361 A1 * 12/2013 Lynch ..... H01L 27/3225 345/204
2013/0328037 A1 * 12/2013 Oshiyama ..... C07F 9/5022 257/40
2014/0028651 A1 * 1/2014 Choi ..... G09G 3/14 345/212
2014/0146029 A1 * 5/2014 Hong ..... G09G 3/3233 345/212
2014/0246654 A1 * 9/2014 Huang ..... H01L 51/504 257/40
2015/0154913 A1 * 6/2015 Kim ..... G09G 3/3233 345/691

FOREIGN PATENT DOCUMENTS

WO 2008057394 5/2008
WO 2010011390 1/2010

OTHER PUBLICATIONS

Baldo, et al., "Very high-efficiency green organic light-emitting devices based on electrophosphorescence", Applied Physics Letters, vol. 75, No. 1, pp. 4-6, Jul. 5, 1999.
First Office Action dated Oct. 25, 2017 in CN 201410814462.7 with partial English Translation.

* cited by examiner

..... means the device can contain up to x EML/BL units, where x can be more than 2.

Evidence of changing recombination profile in response to driving conditions

Sample co-doped with 1% of red emitter 50A next to the electron transport layer interface operated in DC and pulse modes to demonstrate the shift of recombination zone

OLED COLOR TUNING BY DRIVING MODE VARIATION

CROSS-REFERENCE TO RELATED APPLICATIONS

This application claims the benefit of U.S. Provisional Patent Application Ser. No. 61/919,937, filed Dec. 23, 2013 and U.S. Provisional Patent Application Ser. No. 62/077,423, filed Nov. 10, 2014, the entire contents of each of which is incorporated herein by reference.

PARTIES TO A JOINT RESEARCH AGREEMENT

The claimed invention was made by, on behalf of, and/or in connection with one or more of the following parties to a joint university corporation research agreement: Regents of the University of Michigan, Princeton University, University of Southern California, and the Universal Display Corporation. The agreement was in effect on and before the date the claimed invention was made, and the claimed invention was made as a result of activities undertaken within the scope of the agreement.

FIELD OF THE INVENTION

The present invention relates to techniques and systems for operating devices such as OLEDs using various and variable driving schemes, and devices such as organic light emitting diodes and other devices, including the same.

BACKGROUND

Opto-electronic devices that make use of organic materials are becoming increasingly desirable for a number of reasons. Many of the materials used to make such devices are relatively inexpensive, so organic opto-electronic devices have the potential for cost advantages over inorganic devices. In addition, the inherent properties of organic materials, such as their flexibility, may make them well suited for particular applications such as fabrication on a flexible substrate. Examples of organic opto-electronic devices include organic light emitting devices (OLEDs), organic phototransistors, organic photovoltaic cells, and organic photodetectors. For OLEDs, the organic materials may have performance advantages over conventional materials. For example, the wavelength at which an organic emissive layer emits light may generally be readily tuned with appropriate dopants.

OLEDs make use of thin organic films that emit light when voltage is applied across the device. OLEDs are becoming an increasingly interesting technology for use in applications such as flat panel displays, illumination, and backlighting. Several OLED materials and configurations are described in U.S. Pat. Nos. 5,844,363, 6,303,238, and 5,707,745, which are incorporated herein by reference in their entirety.

One application for phosphorescent emissive molecules is a full color display. Industry standards for such a display call for pixels adapted to emit particular colors, referred to as "saturated" colors. In particular, these standards call for saturated red, green, and blue pixels. Color may be measured using CIE coordinates, which are well known to the art.

One example of a green emissive molecule is tris(2-phenylpyridine) iridium, denoted $Ir(ppy)_3$, which has the following structure:

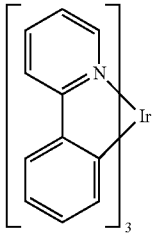

In this, and later figures herein, we depict the dative bond from nitrogen to metal (here, Ir) as a straight line.

As used herein, the term "organic" includes polymeric materials as well as small molecule organic materials that may be used to fabricate organic opto-electronic devices. "Small molecule" refers to any organic material that is not a polymer, and "small molecules" may actually be quite large. Small molecules may include repeat units in some circumstances. For example, using a long chain alkyl group as a substituent does not remove a molecule from the "small molecule" class. Small molecules may also be incorporated into polymers, for example as a pendent group on a polymer backbone or as a part of the backbone. Small molecules may also serve as the core moiety of a dendrimer, which consists of a series of chemical shells built on the core moiety. The core moiety of a dendrimer may be a fluorescent or phosphorescent small molecule emitter. A dendrimer may be a "small molecule," and it is believed that all dendrimers currently used in the field of OLEDs are small molecules.

As used herein, "top" means furthest away from the substrate, while "bottom" means closest to the substrate. Where a first layer is described as "disposed over" a second layer, the first layer is disposed further away from substrate. There may be other layers between the first and second layer, unless it is specified that the first layer is "in contact with" the second layer. For example, a cathode may be described as "disposed over" an anode, even though there are various organic layers in between.

As used herein, "solution processible" means capable of being dissolved, dispersed, or transported in and/or deposited from a liquid medium, either in solution or suspension form.

A ligand may be referred to as "photoactive" when it is believed that the ligand directly contributes to the photoactive properties of an emissive material. A ligand may be referred to as "ancillary" when it is believed that the ligand does not contribute to the photoactive properties of an emissive material, although an ancillary ligand may alter the properties of a photoactive ligand.

As used herein, and as would be generally understood by one skilled in the art, a first "Highest Occupied Molecular Orbital" (HOMO) or "Lowest Unoccupied Molecular Orbital" (LUMO) energy level is "greater than" or "higher than" a second HOMO or LUMO energy level if the first energy level is closer to the vacuum energy level. Since ionization potentials (IP) are measured as a negative energy relative to a vacuum level, a higher HOMO energy level corresponds to an IP having a smaller absolute value (an IP that is less negative). Similarly, a higher LUMO energy level corresponds to an electron affinity (EA) having a smaller absolute value (an EA that is less negative). On a conventional energy level diagram, with the vacuum level at the top, the LUMO energy level of a material is higher than the HOMO energy level of the same material. A "higher"

HOMO or LUMO energy level appears closer to the top of such a diagram than a "lower" HOMO or LUMO energy level.

As used herein, and as would be generally understood by one skilled in the art, a first work function is "greater than" or "higher than" a second work function if the first work function has a higher absolute value. Because work functions are generally measured as negative numbers relative to vacuum level, this means that a "higher" work function is more negative. On a conventional energy level diagram, with the vacuum level at the top, a "higher" work function is illustrated as further away from the vacuum level in the downward direction. Thus, the definitions of HOMO and LUMO energy levels follow a different convention than work functions.

More details on OLEDs, and the definitions described above, can be found in U.S. Pat. No. 7,279,704, which is incorporated herein by reference in its entirety.

SUMMARY OF THE INVENTION

According to an embodiment, an OLED display device may operate by receiving an input signal indicating an apparent luminance to be generated by at least one OLED in the display during a first frame time. A first drive signal may be provided to the at least one OLED, which includes a waveform specifying an output for the OLED during the first frame time. The first drive signal may produce a momentary luminance greater than the apparent luminance for at least a portion of the first frame time. The waveform may be selected from among a plurality of predefined waveforms, which may be stored by the display device. A waveform may be selected based upon, for example, an expected degradation of the OLED, the age of the OLED, in order to activate a selected region of an emissive layer within the at least one OLED, based upon a measurement of an operating parameter of the OLED, based upon a known relationship of luminance efficacy to luminance of the OLED, in order to activate one of a multiple regions of an emissive region of the OLED based upon a desired color of light, to activate an emissive material from of several emissive materials in the OLED, and/or based upon a temperature of the OLED, or the like. The drive signal may specify a voltage and/or a current at which to drive the at least one OLED during the frame time. The total integrated luminance resulting from the waveform during the first frame time may be equivalent to a total integrated luminance of the apparent luminance over the first frame time. The first frame time may be defined, for example, by a single frame of a video provided for display on the OLED display, such as via the input signal. The waveform may be periodic within the first frame time, and may include forms such as square, sawtooth, triangle, sine, peak waveforms, and/or combinations thereof. The waveform may have a frequency equal to or greater than a frame frequency of the input signal, such as the frequency at which individual frames are provided for display on a display device, such as at least 60 Hz, 100 Hz-1 MHz, or the like. The drive signal may specify a current density of not more than 200 mA/cm$^2$, not more than 500 mA/cm$^2$, or the like. The drive signal may include a basic drive voltage, such as a constant DC mode type drive voltage, that is applied concurrently with the waveform. For example, a second drive signal may be provided to the OLED during a second frame time, occurring before or after the initial frame time, which produces a momentary luminance equal to the apparent luminance. The second frame time may occur during receipt of a second input signal different than the first input signal. Each input signal may include multiple image frames, each of which is displayed by the display device for a frame time.

In an embodiment, a display device may include an OLED, a receiver configured to receive a display signal indicating an apparent luminance for the OLED during a first frame time, and a drive circuit in signal communication with the OLED, which is configured to provide a first drive signal to the OLED based upon a waveform generated by a processor. The waveform may define a momentary luminance during at least a portion of the first frame time that is greater than the apparent luminance. The OLED may include multiple emissive layers, each of which may be separated from adjacent emissive layers by a blocking layer. Alternatively or in addition, the OLED may include an emissive region containing multiple regions, each of which is configured to emit light having a peak wavelength different than the other. The display device may include a memory to store multiple waveforms that are selected by the processor, as previously described. The display device may operate according to some or all of the embodiments disclosed herein. The display device can be a consumer product, an organic light-emitting device, and/or a lighting panel or the like.

BRIEF DESCRIPTION OF THE DRAWINGS

FIG. 28A shows the absolute EL spectra. FIG. 28B shows the normalized EL spectra. FIG. 28C shows the CIE and luminance vs. driving conditions.

FIG. 29A shows the absolute EL spectra. FIG. 29B shows the normalized EL spectra. FIG. 29C shows the CIE and luminance vs driving conditions.

FIG. 30A shows the absolute EL spectra. FIG. 30B shoes the normalized EL spectra. FIG. 30C shows the CIE and luminance vs. driving conditions.

FIG. 31A shows the absolute EL spectra. FIG. 31B shows the normalized EL spectra. FIG. 31C shows the CIE and luminance vs driving conditions plot.

DETAILED DESCRIPTION

Generally, an OLED comprises at least one organic layer disposed between and electrically connected to an anode and a cathode. When a current is applied, the anode injects holes and the cathode injects electrons into the organic layer(s). The injected holes and electrons each migrate toward the oppositely charged electrode. When an electron and hole localize on the same molecule, an "exciton," which is a localized electron-hole pair having an excited energy state, is formed. Light is emitted when the exciton relaxes via a photoemissive mechanism. In some cases, the exciton may be localized on an excimer or an exciplex. Non-radiative mechanisms, such as thermal relaxation, may also occur, but are generally considered undesirable.

The initial OLEDs used emissive molecules that emitted light from their singlet states ("fluorescence") as disclosed, for example, in U.S. Pat. No. 4,769,292, which is incorporated by reference in its entirety. Fluorescent emission generally occurs in a time frame of less than 10 nanoseconds.

More recently, OLEDs having emissive materials that emit light from triplet states ("phosphorescence") have been demonstrated. Baldo et al., "Highly Efficient Phosphorescent Emission from Organic Electroluminescent Devices," Nature, vol. 395, 151-154, 1998; ("Baldo-I") and Baldo et al., "Very high-efficiency green organic light-emitting devices based on electrophosphorescence," Appl. Phys. Lett., vol. 75, No. 3, 4-6 (1999) ("Baldo-II"), which are incorporated by reference in their entireties. Phosphorescence is described in more detail in U.S. Pat. No. 7,279,704 at cols. 5-6, which are incorporated by reference.

Figure 1:
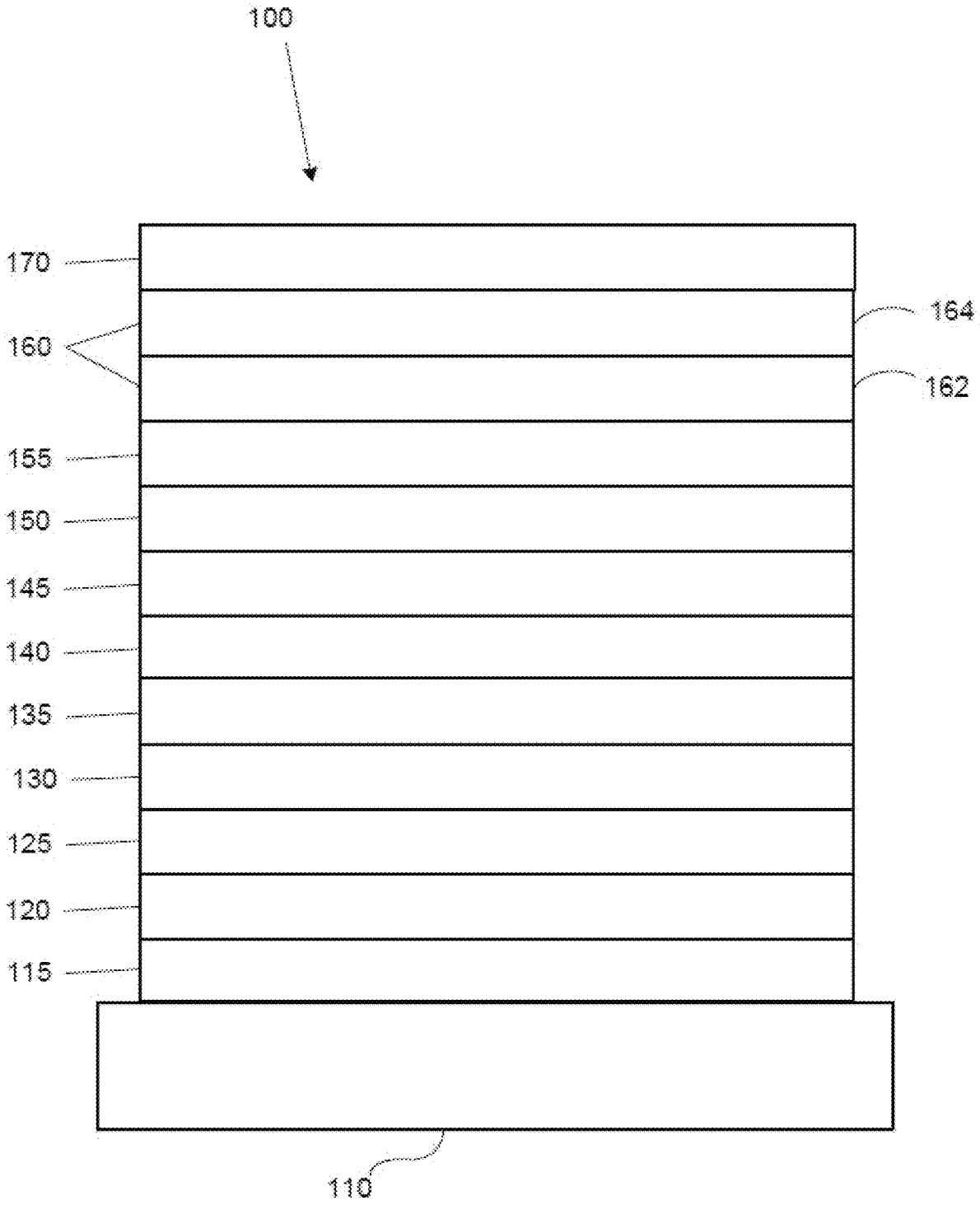
FIG. 1 shows an organic light emitting device.

FIG. 1 shows an organic light emitting device 100. The figures are not necessarily drawn to scale. Device 100 may include a substrate 110, an anode 115, a hole injection layer 120, a hole transport layer 125, an electron blocking layer 130, an emissive layer 135, a hole blocking layer 140, an electron transport layer 145, an electron injection layer 150, a protective layer 155, a cathode 160, and a barrier layer 170. Cathode 160 is a compound cathode having a first conductive layer 162 and a second conductive layer 164. Device 100 may be fabricated by depositing the layers described, in order. The properties and functions of these various layers, as well as example materials, are described in more detail in U.S. Pat. No. 7,279,704 at cols. 6-10, which are incorporated by reference.

More examples for each of these layers are available. For example, a flexible and transparent substrate-anode combination is disclosed in U.S. Pat. No. 5,844,363, which is incorporated by reference in its entirety. An example of a p-doped hole transport layer is m-MTDATA doped with $F_4$-TCNQ at a molar ratio of 50:1, as disclosed in U.S. Patent Application Publication No. 2003/0230980, which is incorporated by reference in its entirety. Examples of emissive and host materials are disclosed in U.S. Pat. No. 6,303,238 to Thompson et al., which is incorporated by reference in its entirety. An example of an n-doped electron transport layer is BPhen doped with Li at a molar ratio of 1:1, as disclosed in U.S. Patent Application Publication No. 2003/0230980, which is incorporated by reference in its entirety. U.S. Pat. Nos. 5,703,436 and 5,707,745, which are incorporated by reference in their entireties, disclose examples of cathodes including compound cathodes having a thin layer of metal such as Mg:Ag with an overlying transparent, electrically-conductive, sputter-deposited ITO layer. The theory and use of blocking layers is described in more detail in U.S. Pat. No. 6,097,147 and U.S. Patent Application Publication No. 2003/0230980, which are incorporated by reference in their entireties. Examples of injection layers are provided in U.S. Patent Application Publication No. 2004/0174116, which is incorporated by reference in its entirety. A description of protective layers may be found in U.S. Patent Application Publication No. 2004/0174116, which is incorporated by reference in its entirety.

Figure 2:
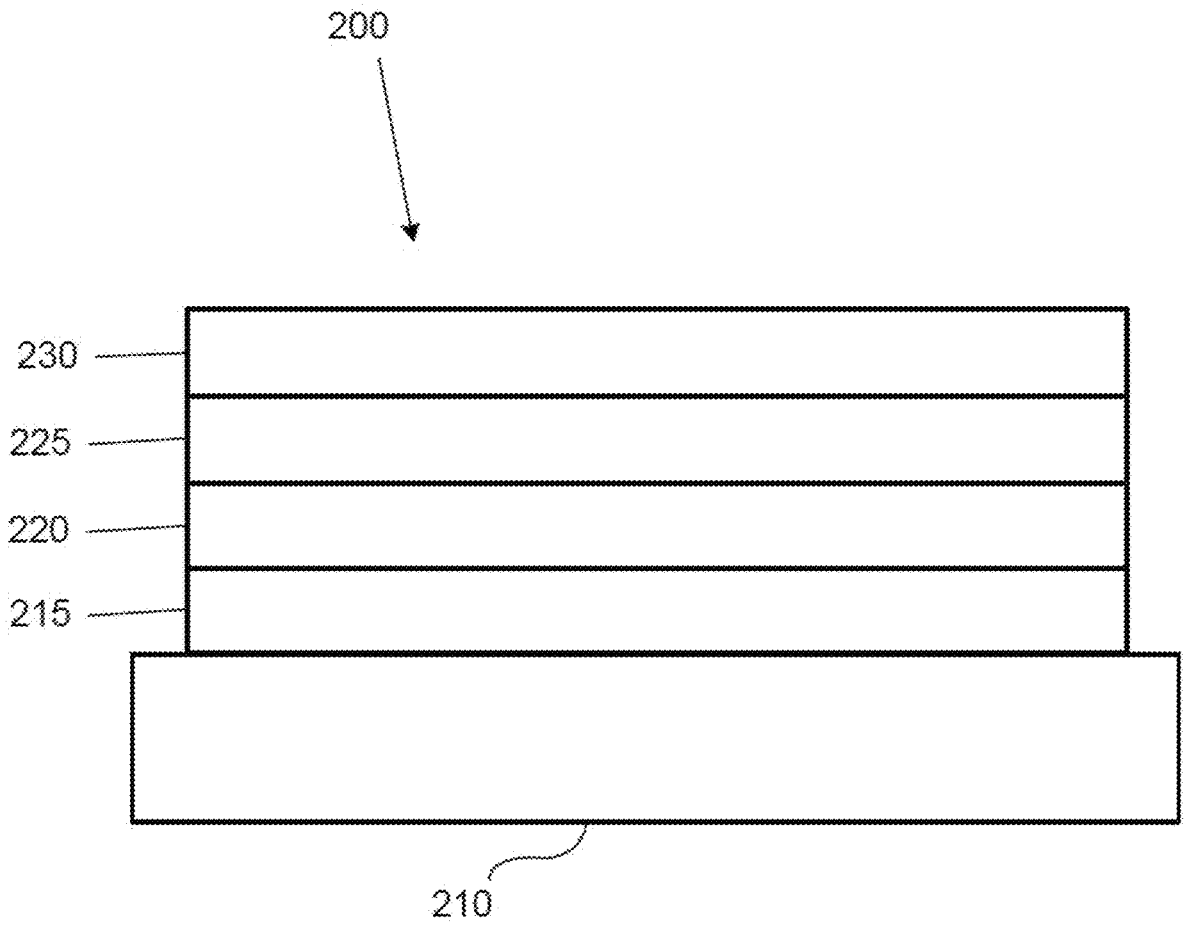
FIG. 2 shows an inverted organic light emitting device that does not have a separate electron transport layer.

FIG. 2 shows an inverted OLED 200. The device includes a substrate 210, a cathode 215, an emissive layer 220, a hole transport layer 225, and an anode 230. Device 200 may be fabricated by depositing the layers described, in order. Because the most common OLED configuration has a cathode disposed over the anode, and device 200 has cathode 215 disposed under anode 230, device 200 may be referred to as an "inverted" OLED. Materials similar to those described with respect to device 100 may be used in the corresponding layers of device 200. FIG. 2 provides one example of how some layers may be omitted from the structure of device 100.

The simple layered structure illustrated in FIGS. 1 and 2 is provided by way of non-limiting example, and it is understood that embodiments of the invention may be used in connection with a wide variety of other structures. The specific materials and structures described are exemplary in nature, and other materials and structures may be used. Functional OLEDs may be achieved by combining the various layers described in different ways, or layers may be omitted entirely, based on design, performance, and cost factors. Other layers not specifically described may also be included. Materials other than those specifically described may be used. Although many of the examples provided herein describe various layers as comprising a single material, it is understood that combinations of materials, such as a mixture of host and dopant, or more generally a mixture, may be used. Also, the layers may have various sublayers. The names given to the various layers herein are not intended to be strictly limiting. For example, in device 200, hole transport layer 225 transports holes and injects holes into emissive layer 220, and may be described as a hole transport layer or a hole injection layer. In one embodiment, an OLED may be described as having an "organic layer" disposed between a cathode and an anode. This organic layer may comprise a single layer, or may further comprise multiple layers of different organic materials as described, for example, with respect to FIGS. 1 and 2.

Structures and materials not specifically described may also be used, such as OLEDs comprised of polymeric materials (PLEDs) such as disclosed in U.S. Pat. No. 5,247,190 to Friend et al., which is incorporated by reference in its entirety. By way of further example, OLEDs having a single organic layer may be used. OLEDs may be stacked, for example as described in U.S. Pat. No. 5,707,745 to Forrest et al, which is incorporated by reference in its entirety. The OLED structure may deviate from the simple layered structure illustrated in FIGS. 1 and 2. For example, the substrate may include an angled reflective surface to improve outcoupling, such as a mesa structure as described in U.S. Pat. No. 6,091,195 to Forrest et al., and/or a pit structure as described in U.S. Pat. No. 5,834,893 to Bulovic et al., which are incorporated by reference in their entireties.

Unless otherwise specified, any of the layers of the various embodiments may be deposited by any suitable method. For the organic layers, preferred methods include thermal evaporation, ink-jet, such as described in U.S. Pat. Nos. 6,013,982 and 6,087,196, which are incorporated by reference in their entireties, organic vapor phase deposition (OVPD), such as described in U.S. Pat. No. 6,337,102 to Forrest et al., which is incorporated by reference in its entirety, and deposition by organic vapor jet printing (OVJP), such as described in U.S. Pat. No. 7,431,968, which is incorporated by reference in its entirety. Other suitable deposition methods include spin coating and other solution based processes. Solution based processes are preferably carried out in nitrogen or an inert atmosphere. For the other layers, preferred methods include thermal evaporation. Preferred patterning methods include deposition through a mask, cold welding such as described in U.S. Pat. Nos. 6,294,398 and 6,468,819, which are incorporated by reference in their entireties, and patterning associated with some of the deposition methods such as ink-jet and OVJD. Other methods may also be used. The materials to be deposited may be modified to make them compatible with a particular deposition method. For example, substituents such as alkyl and aryl groups, branched or unbranched, and preferably containing at least 3 carbons, may be used in small molecules to enhance their ability to undergo solution processing. Substituents having 20 carbons or more may be used, and 3-20 carbons is a preferred range. Materials with asymmetric structures may have better solution processability than those having symmetric structures, because asymmetric materials may have a lower tendency to recrystallize. Dendrimer substituents may be used to enhance the ability of small molecules to undergo solution processing.

Devices fabricated in accordance with embodiments of the present invention may further optionally comprise a barrier layer. One purpose of the barrier layer is to protect the electrodes and organic layers from damaging exposure to harmful species in the environment including moisture, vapor and/or gases, etc. The barrier layer may be deposited over, under or next to a substrate, an electrode, or over any other parts of a device including an edge. The barrier layer may comprise a single layer, or multiple layers. The barrier layer may be formed by various known chemical vapor deposition techniques and may include compositions having a single phase as well as compositions having multiple phases. Any suitable material or combination of materials may be used for the barrier layer. The barrier layer may incorporate an inorganic or an organic compound or both. The preferred barrier layer comprises a mixture of a polymeric material and a non-polymeric material as described in U.S. Pat. No. 7,968,146, PCT Pat. Application Nos. PCT/US2007/023098 and PCT/US2009/042829, which are herein incorporated by reference in their entireties. To be considered a "mixture", the aforesaid polymeric and non-polymeric materials comprising the barrier layer should be deposited under the same reaction conditions and/or at the same time. The weight ratio of polymeric to non-polymeric material may be in the range of 95:5 to 5:95. The polymeric material and the non-polymeric material may be created from the same precursor material. In one example, the mixture of a polymeric material and a non-polymeric material consists essentially of polymeric silicon and inorganic silicon.

Devices fabricated in accordance with embodiments of the invention can be incorporated into a wide variety of electronic component modules (or units) that can be incorporated into a variety of electronic products or intermediate components. Examples of such electronic products or intermediate components include display screens, lighting devices such as discrete light source devices or lighting panels, etc. that can be utilized by the end-user product manufacturers. Such electronic component modules can optionally include the driving electronics and/or power source(s). Devices fabricated in accordance with embodiments of the invention can be incorporated into a wide variety of consumer products that have one or more of the electronic component modules (or units) incorporated therein. Such consumer products would include any kind of products that include one or more light source(s) and/or one or more of some type of visual displays. Some examples of such consumer products include flat panel displays, computer monitors, medical monitors, televisions, billboards, lights for interior or exterior illumination and/or signaling, heads-up displays, fully or partially transparent displays, flexible displays, laser printers, telephones, cell phones, tablets, phablets, personal digital assistants (PDAs), laptop computers, digital cameras, camcorders, viewfinders, micro-displays, 3-D displays, vehicles, a large area wall, theater or stadium screen, or a sign. Various control mechanisms may be used to control devices fabricated in accordance with the present invention, including passive matrix and active matrix. Many of the devices are intended for use in a temperature range comfortable to humans, such as 18 C to 30 C, and more preferably at room temperature (20-25 C), but could be used outside this temperature range, for example, from −40 C to +80 C.

Many OLED devices and types of devices, such as multi-layer phosphorescent OLED devices, may not age uniformly when operated or aged under a constant DC current. The charge balance and/or recombination rate profile across the emissive layer or layers of the OLED components may change as a result of device aging, which often leads to undesirable effects such as color alteration, efficiency decreases, and "image sticking".

The charge balance and/or recombination rate profile also may change in response to a change in driving current. Thus, according to embodiments disclosed herein, the profile of OLED device recombination zones may be modified by changing the device structure, and/or by adjusting the driving conditions. Specifically, driving such a device using different current/voltage profiles can be used to modify the recombination profile of an aged device and, in some cases, partially or entirely recover efficiency losses due to aging. Techniques as disclosed herein may be continuous during operation of a device, and may be interactive based upon operation of the device, specific input signals, and the like. The application of non-DC driving schemes also may extend the device relative lifetime, though in some cases such gains may come at the expense of luminous efficiency. Driving waveforms also may be designed to minimize the image sticking effect in OLED-based displays.

Figure 3:
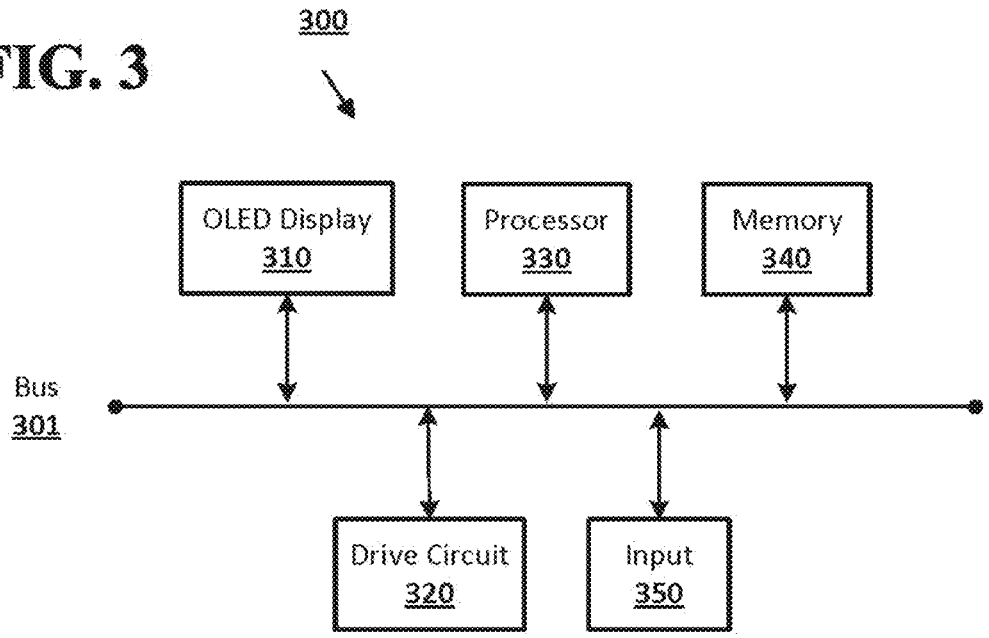
FIG. 3 shows an example schematic representation of a display device according to embodiments disclosed herein.

FIG. 3 shows an example schematic representation of a display device according to embodiments disclosed herein. A display device 300 may include a display 310 such as an OLED display that includes one or more OLEDs as previously described. An input 350 such as a signal receiver 350 may receive an input signal, such as from an external source or a receiver internal to the device 300. The display signal may indicate, among other information, an apparent luminance at which various portions of the OLED display should be operated to achieve a desired output of the display. For example, where the device 300 is a full-color display, the input signal may indicate an apparent luminance for various pixels within the display device 300, which thus indicates the apparent luminance for various OLEDs within the display 310. In some cases the input signal may not explicitly define an apparent luminance for an OLED, but may provide sufficient image data or other data that the display device is able to immediately determine the apparent luminance at which any given OLED in the display device is to be driven to achieve the image embodied in the input signal. The input signal may be divided into and received as various frames, each lasting for an associated frame time. For example, where the device 300 is a full-color display displaying a video or the like, the input signal may include individual frames that define the frames of the video, each frame including an associated frame time. A processor 330 may generate various waveforms that control how the OLED display 310 should be driven. For example, a waveform may define a momentary luminance at which an OLED within the display 310 is to be driven. Such a waveform may be used to control operation of an OLED in the display 310 using, for example, drive circuitry 320, as will be readily understood by one of skill in the art. The various components of the display device 300 may communicate via one or more buses 301 or any other suitable mechanism, as is readily understood by one of skill in the art.

According to embodiments disclosed herein, a waveform generated by the processor 330 may define a momentary luminance that is greater than the apparent luminance indicated by an input signal for at least a portion of the frame time for which the apparent luminance is indicated. That is, an OLED in the display 310 may be driven at a higher luminance for a portion of a frame than the luminance indicated for that frame by an input signal. The waveform may have various shapes and properties, and may have a frequency greater than the frame frequency of a signal that indicates the apparent luminance for the OLED being driven. As described in further detail below, various preconfigured waveforms may be used, which may be stored in a memory 340 in or accessible by the display device 300. Such operation may be contrasted to conventional operation in which an OLED in the display 300 is driven at a constant luminance corresponding to the apparent luminance indicated by an input signal. Such operation, in which a constant luminance is used, may be referred to as a "DC mode" since typically a constant DC current and/or voltage is used to drive the OLED. In contrast, the use of a selected and/or varying waveform to drive an OLED as disclosed herein may be referred to as a "pulsed mode" of operation, because waveforms used in such modes may resemble a "pulse" more than a constant applied current or voltage. However, it will be understood that a "pulsed mode" operation may, but need not, use a regular, repeated waveform having uniform pulses applied at regular intervals over a period of time. In fact, as described in further detail herein, the specific waveforms applied during a pulsed mode operation as disclosed may vary with time, such as where different waveforms are selected and/or applied based upon a lifetime of an OLED in a display, and different pulsed modes may be applied to the OLED at different times.

In general, the total integrated luminance resulting from a pulsed mode waveform during a particular time may be equivalent to the total integrated luminance of an apparent luminance, such as specified by an input signal as previously disclosed, over the same time. Any suitable waveform may be used, and the waveform may be periodic over the time that it is used to drive an OLED. Example waveforms that may be used include a square wave, a sawtooth wave, a triangle wave, a sine wave, a single narrow peak, and combinations thereof.

Figure 4:
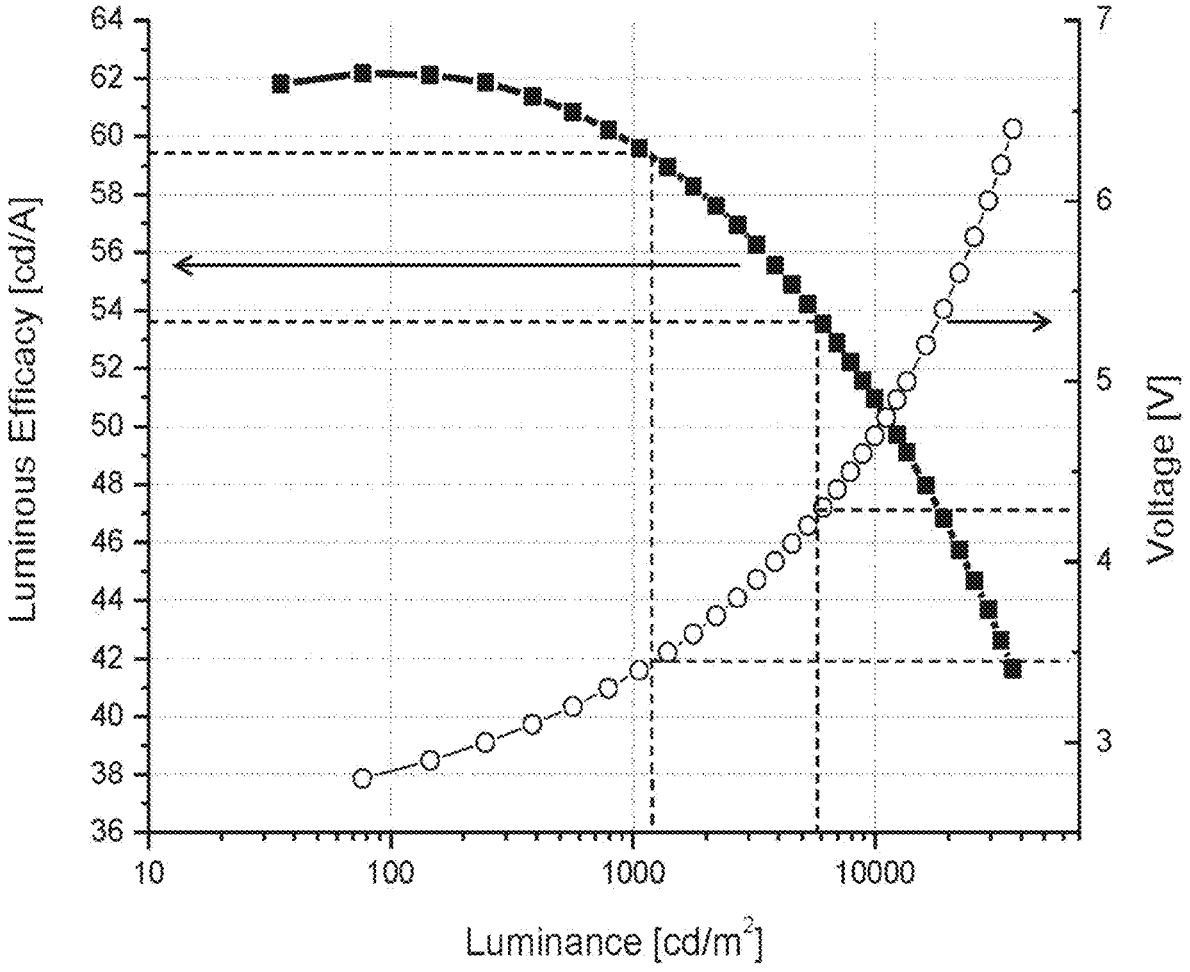
FIG. 4 shows different driving conditions that result in the same apparent luminance of a device according to an embodiment.

More specifically, the same visible (integrated) luminance Li of a device such as an OLED, LED, or any other light source with fast response time, can be obtained either by driving the device in a DC mode at the desired apparent luminance Lo, or in pulsed mode as disclosed herein at a higher momentary luminance, which to the viewer appears the same as Lo. In general, for a conventional, non-tunable OLED, the integrated luminance is equal to the momentary luminance multiplied by the duty cycle factor. In contrast, according to embodiments disclosed herein, a combination of duty cycle and momentary luminance can be used to tune the resulting visible luminance. For example, at frequencies of 60 Hz or higher, a momentary luminance as disclosed herein typically will be indistinguishable or nearly indistinguishable to the human eye. FIG. 4 shows example luminance data for an illustrative OLED, which demonstrates that the same apparent luminance of the device can be obtained by driving the device at low luminance in DC mode, or at a high momentary luminance in a pulsed mode. As shown, a momentary voltage and luminous efficacy at the DC luminance of 1220 cd/m$^2$ matches 6100 nits in a pulsed mode of 1000 Hz and 20% duty factor. Table 1 shows example values of driving conditions that can be used to obtain the same viewable apparent luminance of the device. The example device structure is shown in Table 4.

The specific waveform applied in a pulsed mode for a particular device may change over time. For example, a display device may generate or select a specific waveform based on the age and/or expected degradation of an OLED that the waveform is being used to drive. As another example, a device may use one waveform in which the apparent luminance is equal to the momentary luminance, or may operate in a DC mode for a period of time. At another point in time the device may operate using a waveform with a momentary luminance greater than the apparent luminance, for example due to the age of the OLED being driven.

Figure 5:
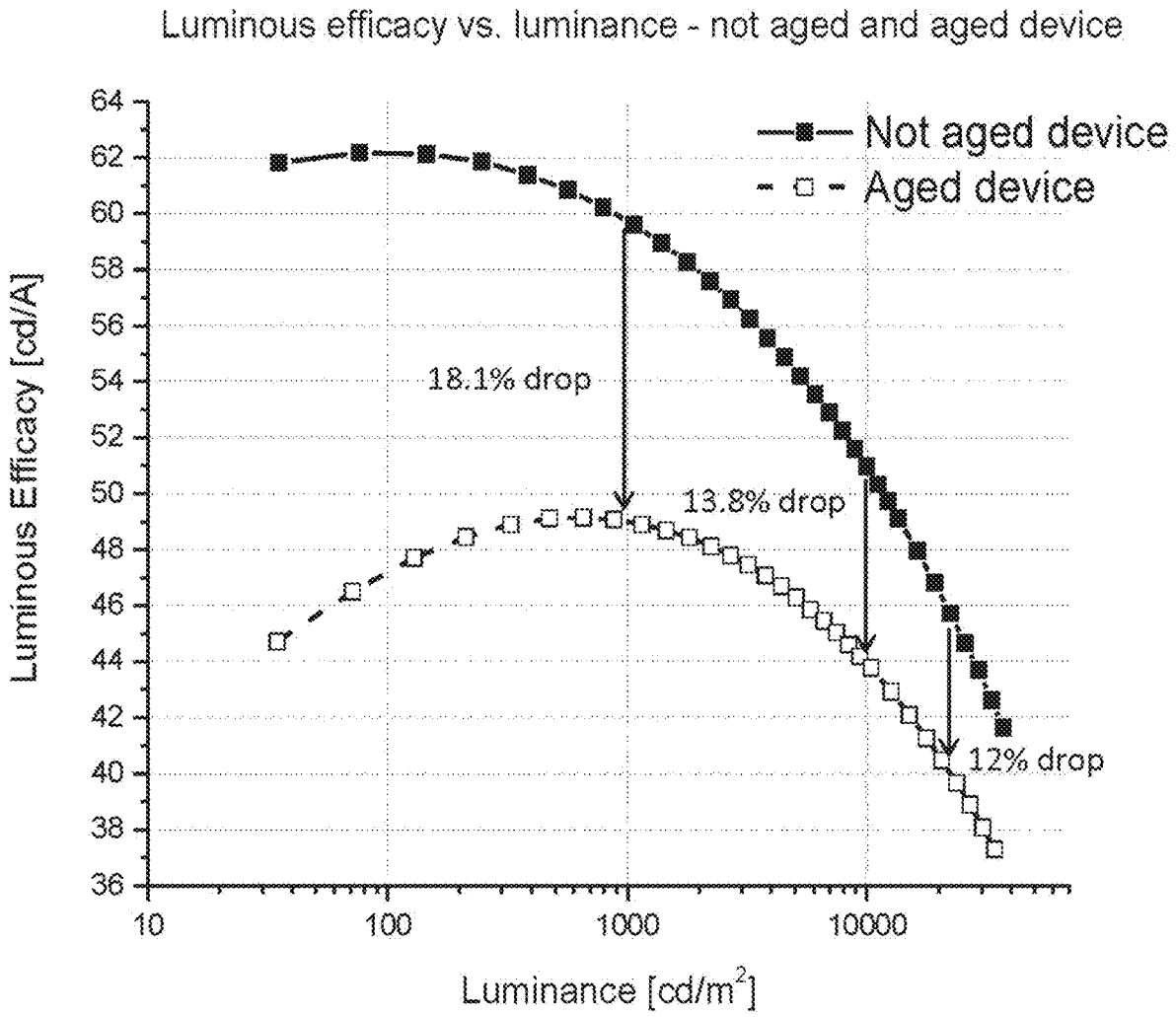
FIG. 5 shows a relative loss of luminous efficacy upon aging as a function of operating current density for a device aged at a 40 mA/cm$^2$ DC mode according to an embodiment.

Embodiments disclosed herein may reduce or eliminate the image "sticking" problem that occurs in some OLED displays, i.e., the difference between aged and non-aged devices due to changes in pixels in the OLED display. FIG. 5 shows an example plot of luminous efficacy for an aged device and a non-aged device as a function of luminance. Similar data is provided in Table 2, which shows the relative loss of luminous efficacy as a function of operation luminance. Such data indicate that less aging occurs at high luminance compared to low luminance. Therefore, driving the aged and non-aged device at a high luminance pulsed mode can result in less difference between aged and non-aged pixels, and thus extend device useful lifetime. This also indicates that the relative loss of device luminous efficacy due to aging can be affected by changing the operation mode of the device, for example by using combinations of low luminance DC driving modes and high luminance pulsed modes. Under pulsed driving conditions the relative loss of luminous efficacy may be smaller than the loss under the equivalent DC driving conditions. This has been further confirmed in aging experiments, as described herein with respect to FIGS. 12, 14, and 15.

Figure 6:
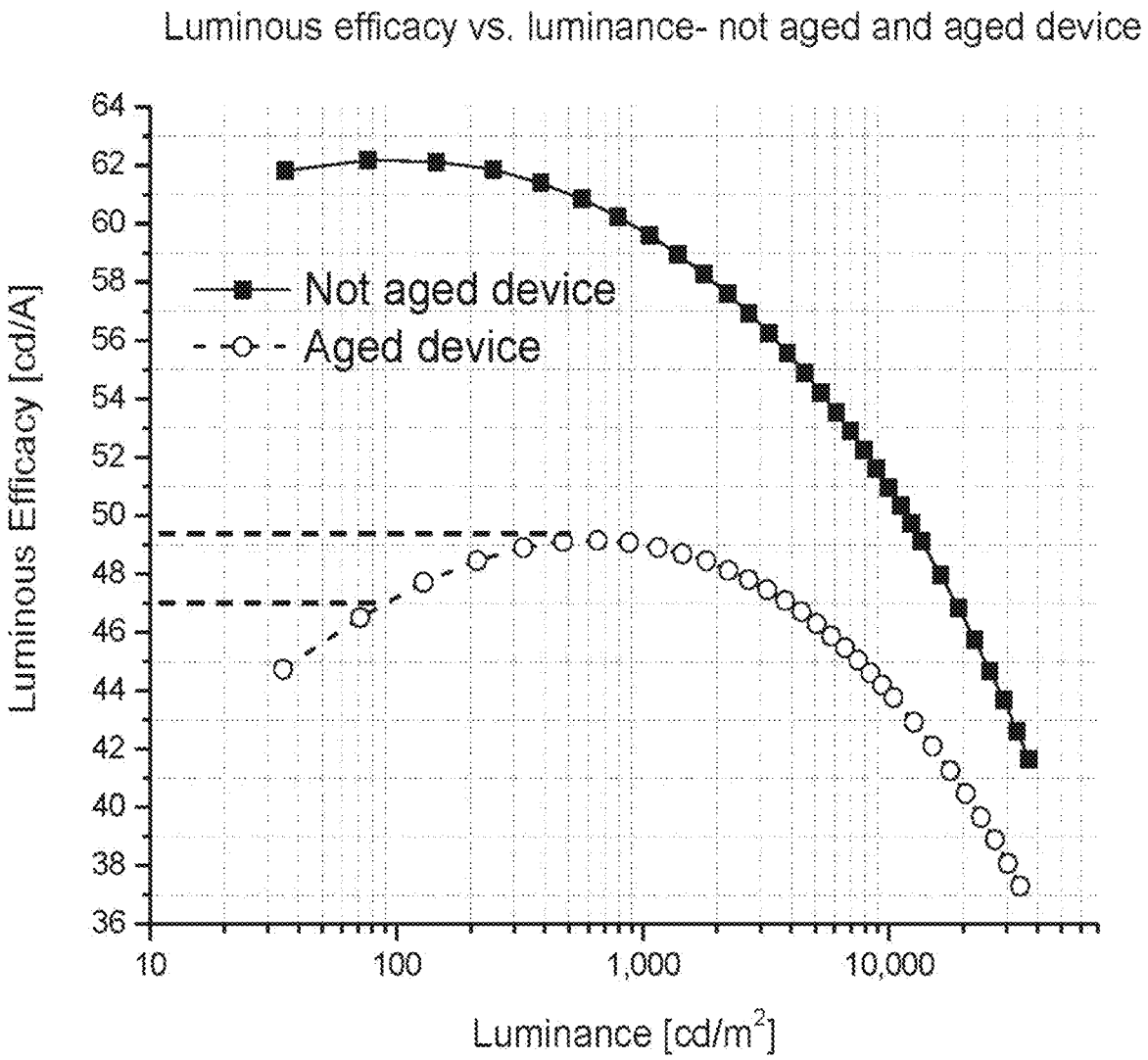
FIG. 6 shows the luminous efficacy gain for an aged device in a lower luminance range due to a different driving mode for a device aged at a 40 mA/cm$^2$ DC mode according to an embodiment.
Figure 13:
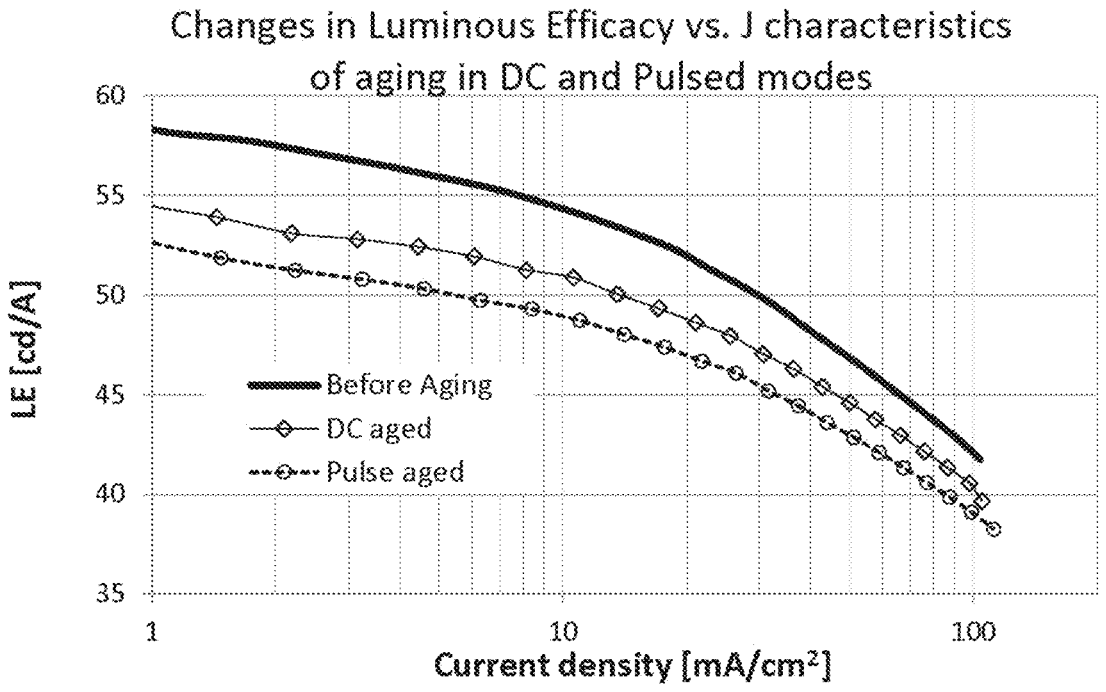
FIG. 13 shows an example of changes in luminous efficacy vs. current density characteristics after aging in DC and pulsed modes according to an embodiment.

Alternatively or in addition, tuning a device structure to obtain a desired luminous efficacy vs. luminance plot for an aged device, in combination with a pulsed driving mode, may provide an additional efficacy increase of the aged device, which is equivalent to improving the lifetime. Such a technique may be particularly effective if the device is operated at a relatively low luminance (See FIG. 6 and table 3). For example, FIG. 6 shows the luminous efficacy as a function of luminance for aged and not-aged devices, which indicates that the luminous efficacy of an aged device can be increased by selecting the driving conditions of the aged device. As shown, the effect is more pronounced in the low luminance range. Table 3 provides example data showing the luminous efficacy gain at lower luminance ranges due to the use of different driving modes. Although more pronounced at lower luminance ranges, lifetime improvements also may be achieved in aged devices operated at both DC and pulsed modes in higher luminance ranges, for example as shown in FIG. 13.

Figure 7:
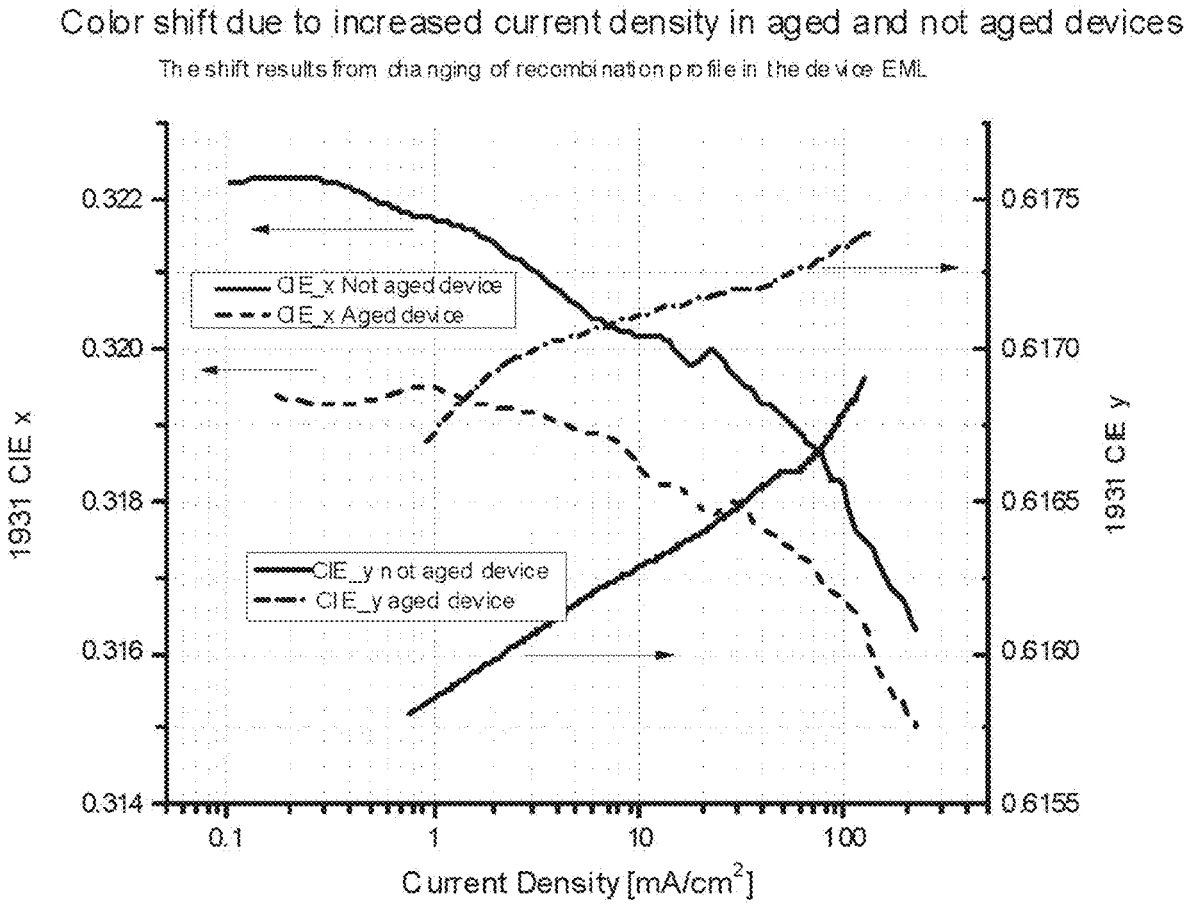
FIG. 7 shows the color shift as a function of current density for aged and non-aged devices for a device aged at a 40 mA/cm$^2$ DC mode according to an embodiment.
Figure 8:
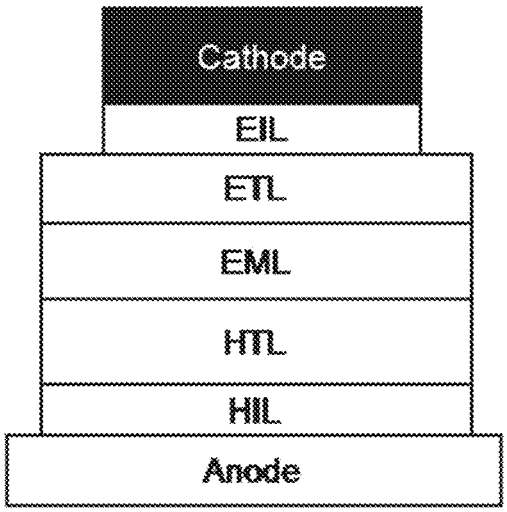
FIG. 8 shows an example schematic device structure according to an embodiment.

The explanation of these phenomena likely is the changing of the recombination profile in the OLED device emissive layer or layers, in response to changing current density and age. FIG. 7 demonstrates the change of emitted light CIE coordinates for an OLED as a function of current (luminance) and aging. As described in further detail herein, this color shift demonstrates the changing of the recombination zone position in the device EML. Changes in the device color upon aging also may demonstrate that the recombination zone profile in the EML changes upon device aging. The example shown in FIG. 7 is for a 74% aged device. The fine variation in CIE of the device typically occurs due to changes in the light optical path, such as increases or decreases of the distance between the light generation position and the cathode and anode. If CIE changes are observed within the same device upon aging and upon varying the luminance (i.e., varying the current/voltage), this may indicate that the recombination zone in which photons are generated can change with current and upon aging. Thus, the additional benefits of increased device lifetimes may be explained by aging the device emissive layer in one location (e.g. recombination location 1) and then shifting the recombination zone by changing the driving mode, into a different, less degraded location in the emissive layer (e.g. recombination location 2).

Such an effect may be demonstrated in an experiment in which two identical pixels are simultaneously aged, one driven in a DC mode and the other in a pulsed mode. Such an experiment is described herein. The experiment results show that the device aged using a constant-current DC mode becomes brighter when switched to a pulsed mode that uses parameters that generate the same Lo as the DC mode, as shown and described with respect to FIG. 14 and Table 6. The pulsed mode aged device loses luminance when switched to the DC mode, as shown in FIG. 15 and Table 6. It is believed that this behavior results because the higher momentary voltage applied in a pulsed mode changes the recombination profile in the emissive layer, in comparison to the low voltage DC mode. For example, the recombination profile may be close to the HTL in a DC mode, and shifts to the ETL in the pulsed mode, or vice-versa, i.e., close to the HTL in a pulsed mode, and closer to the ETL in a DC mode.

Figure 11:
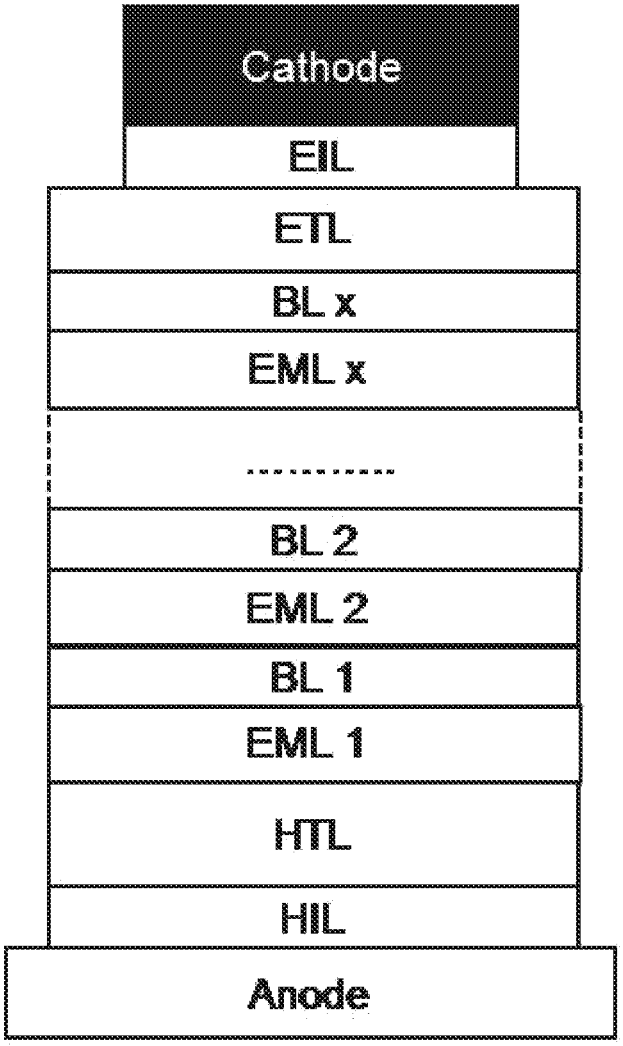
FIG. 11 shows an example of a schematic multiple quantum well device architecture (MQW) according to an embodiment.

These effects may be used advantageously by modifying the OLED device architecture. For example, a device with multiple emissive layers (EMLs) may be constructed in which each EML is separated by a thin blocking layer, such as a 1-5 nm layer. The blocking layer may block excitons from migrating from one EML zone to another, while also facilitating charge transport through the blocking layer, such as via tunneling. An example of such a device is shown in FIG. 11, which includes x EML units, where x can be 2 or more. The multiple EML/blocking layer configuration is similar to a multiple quantum well architecture (MQW). It may be preferred for each blocking layer to have a higher triplet state energy level, in the case of phosphorescent devices, and/or a higher singlet energy level, than the EML layer. Embodiments disclosed herein then may use a pulsed mode driving waveform to be altered to reduce the loss in luminance as one EML zone is aged, such that the recombination zone can be moved or spread differently over adjacent EML regions.

Embodiments disclosed herein in which different waveforms are used as part of an OLED driving scheme are not limited to a set of fixed conditions with the main focus on slowing down the aging process that occurs during normal operation of the OLED-based devices. As described herein, such adjustments made via pulsed mode driving waveforms may be made as part of a dynamic process that extends the life and functionality of the devices, by responding to the changing recombination profile of an aged device over the lifetime of the device. That is, different pulsed modes may be applied to the same device at different times.

Figure 10A:
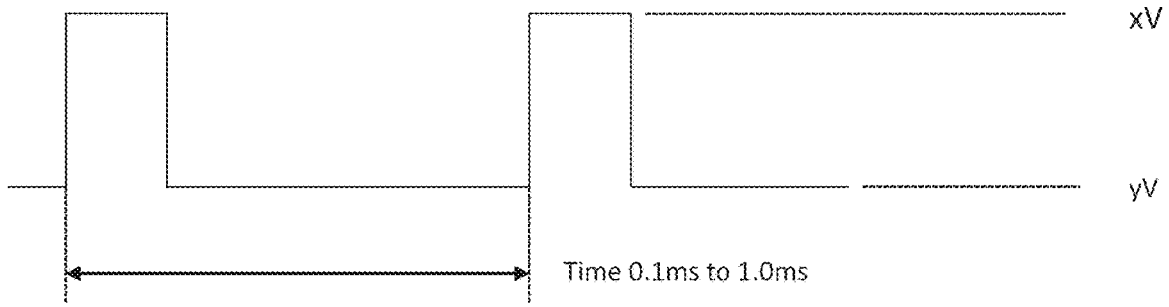
FIGS. 10A and 10B show examples of different waveforms used to drive OLEDs according to embodiments disclosed herein.
Figure 10B:
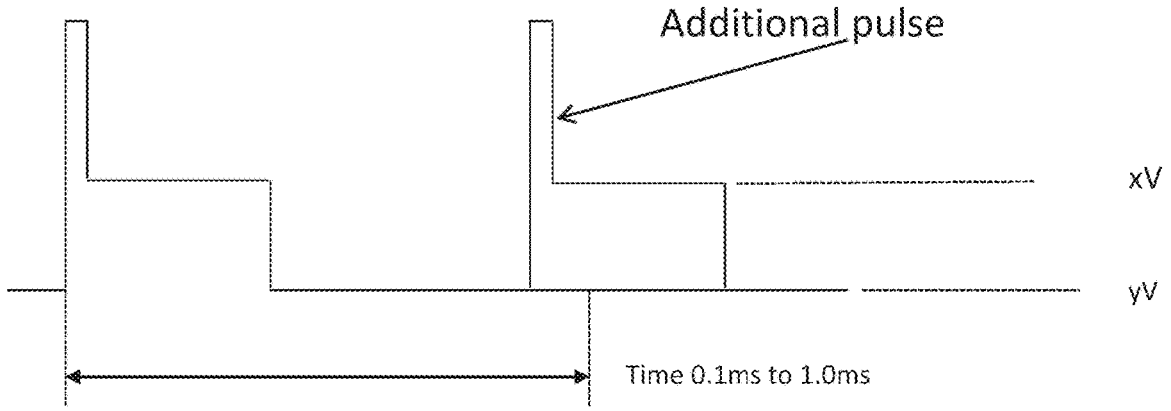

The range of parameters used in a particular pulsed mode, such as repetition frequency, the pulse width, and the duty factor, may be specific to an application using the OLED device. For example, specific values may be set dynamically or prior to operation of the device, based upon the lifetime, expected degradation of OLEDs, and/or other factors specific to an individual OLED display device. Similarly, the shape and size of the pulse itself may be optimized for a maximum response of an OLED device, depending on its luminance vs current characteristics, which is defined by the recombination profile. FIGS. 10A and 10B show examples of different waveforms that may be used to drive OLEDs. FIG. 10A shows a square waveform with 1 kHz or 10 kHz frequency, bias yV of y=−0 or −5 to +3V, and a duty factor ranging from 20% to 80%, and a voltage x of +3V to 8V. FIG. 10B shows a square waveform with a 1 kHz or 10 kHz frequency, a bias yV of y=0, duty factor ranging from 40% to 80%, and voltage x of +3V to +8V. An additional narrow pulse with a relatively high V is added at the beginning of each cycle. Such a pulse may charge the device relatively quickly. Thus, the rate at which the device initially charges may be controlled by the additional of a narrow initial pulse, and by changing the amplitude and duration of the pulse.

The examples shown in FIGS. 10A and 10B and described in the experiments disclosed herein are illustrative, but other waveforms may be used. For example, in a DC-driven device, a periodic pulse may be added to a basic driving DC voltage to promote the transport of the current carriers away from DC mode-defined recombination zones and avoid recombination occurring in areas with a relatively large concentration of quenchers. The range of frequency in this case would be primarily limited by the size of a single pixel in the display, which defines the capacitance of the device. A typical frequency for such a configuration may be in the range of 100 Hz-1 MHz. This configuration may apply, for example, in the case of a square pulse, used in this case to operate the device at a higher momentary current and voltage in a pulsed mode. At higher frequencies, the device may not have time to fully discharge between the pulses, which may cause the device to operate essentially in the DC mode, which may defeat the purpose of using a pulsed mode waveform. Thus, it may be desirable to discharge the OLED device before each pulse to achieve the goal of changing the recombination profile. A preferred operation frequency may be about 100 kHz for a typical active matrix pixel size.

The amplitude of the pulse may be limited by the DC current capacity of the injection mechanism, and is typically less than 500 mA/cm$^2$, with the upper limit being also related to the Joule heating of the substrate, depending on the duty factor of the waveform. A preferred operation current may be 200 mA/cm$^2$ or less. Higher current density values may require higher voltage, potentially increasing the leakage current and eventually exceeding the device breakdown voltage.

As another example, a saw-tooth or stepping voltage may be applied to widen the physical shape of the recombination profile during the device operation. The limitations of resulting RMS would be the same as in the DC case, but an additional limit may result from the device breakdown voltage, typically about 15V for devices with EML thickness of about 300 Å.

As another example, a high frequency waveform may be used to lower the movement of the space charge affecting device stability. The limit of such a waveform may be in the single MHz range, which is primarily limited by the capacitance of the pixel. Smaller pixels of the size of less than 1 mm$^2$ may be driven at higher frequencies. Typically such pixels may be driven at up to about 20 MHz.

As another example, in OLED displays typically driven at a 60 Hz refresh rate, the gray scale digital signal may be preserved by using an increased amplitude and shortened duration. In this case, each pixel on-time may be considered as the DC signal, and may be replaced with a square-wave signal of increased amplitude and frequency, limited by the driving circuit. An appropriate frequency limit typically is approximately the same as in a DC-mode, i.e., about 300 Hz to 10 MHz.

A display device as disclosed herein may use multiple waveforms in a pulsed mode at different points in time, for example based upon the age of the OLED being driven. As previously described, a display device may store multiple waveforms, such as in a computer-readable memory, within the display device. The specific waveforms stored may be pre-calculated. For example, a particular OLED structure may be fabricated and tested to determine an expected lifetime and/or degradation profile over time, a relationship between luminous efficacy and luminance of the OLED, or the like. Waveforms may be selected that correspond to the expected profile. Thus, as the OLED ages, different waveforms may be used based upon the OLEDs age, expected degradation, or the like. As described in further detail below, a pulsed mode waveform also may be selected based upon a desired region of one or more emissive layers, emissive materials, or the like within the OLED that are to be activated, i.e., caused to emit light, when the OLED is driven with the waveform. During operation of a device such as a display device as disclosed herein, a waveform also may be selected based upon various operating characteristics of the OLED. For example, an OLED may be expected to degrade faster or to exhibit certain color, luminance, or other characteristics at a given temperature. Thus, a current or historical temperature of the OLED may be used to select a waveform.

DC mode aging appears not to uniformly affect the EML. Thus, a waveform may be crafted to gradually address wider zones of the EML, allowing access to areas of the EML with a more favorable concentration of undamaged emitters and smaller concentrations of quenchers. For example, a waveform may be used in which every square, or essentially DC-like pulse starts with a high voltage, very short pulse, thus pulling the injection and drift of the carriers beyond the narrow damaged zone near the EML interface.

The use of pulsed mode driving schemes as disclosed herein may provide several advantages in addition to those previously described. For example, the same visible luminance may be achieved in many different ways. As a specific example, changing the duty factor of a standard square wave may result in the same luminance under very different transient voltage. However, the different voltages applied to the device may change the local carrier densities by affecting both the injection and transport processes and resulting in different profiles of recombination as previously described.

As another example, the efficiency drop due to device aging can be changed by varying the operation mode of the device, such as by switching from a low luminance DC mode to a high luminance pulsed mode, as previously described. The relative difference between aged and non-aged devices may be smaller, as shown, for example, in FIG. 5 and Table 2.

As another example, the shape of a device's efficiency curve may be designed to obtain additional efficiency for an aged device by driving it in a pulsed mode with higher momentary luminance and the same apparent luminance.

As another example, the practical lifetime of a device operated at a specific luminance may be extended by using a pulse mode after driving in a DC mode for a period of time, and thus moving the recombination profile to include the less damaged areas of the device EML Another example advantage of a pulsed mode is that the device may have time to dissipate power between pulses, and thus can be driven with relatively high transient luminance. This may provide the possibility of electronically modifying the color or other features of a display or a single light source. In fact, the color of an OLED, such as a multi-EML device, may be tuned by changing the recombination profile and/or the recombination zone (RZ) position within the device EML, separately from any considerations related to the lifetime, efficacy, or other previously-described aspects of device operation.

For example, a device EML may include at least 2 regions emitting light with different colors. In certain device architectures, the RZ position may be moved by changing the device luminance by increasing the driving current or field, i.e., driving the OLED at a higher DC mode current or voltage. In this case the color may be changeable; however, the device luminance would change as well. However, driving the device in a pulsed mode with high momentary luminance and a low integrated luminance as previously described, may provide a means to tune the device color without changing the emission intensity. Similarly, the same structure may be color tuned at the same luminance by changing the driving pulse width and or waveform frequency.

Color tuning may be also performed for a device containing more than one emitter each with different EL transient decay times. This may be single EML device. In this case driving the device with short pulses results in enhancing the slow emitter component in the device emission, whereas the driving the device with long pulses enhances the fast component emission. The same luminance with different color can be achieved by a combination of pulse width and duty factor. This technique utilizes the decaying luminance at the end of the pulse which is dominated by the slow emitter. Different shapes of waveforms are demonstrated for this device color tuning.

For both types of color tunable structures, the device luminance level may be changed while maintaining the same CIE at two different colors. For example, the luminance may be changed for the same device which emits red or yellow. Such effects may be achieved through variation of driving parameters as disclosed herein, such as momentary current density, duty factor (DF), pulse width and frequency. When used for display devices, such techniques may result in simpler fabrication techniques, since the device fabrication may require less use of high precision masks and fewer deposition steps.

In general, an OLED having multiple EMLs or emissive regions may be color tuned by driving the OLED using different pulsed mode waveforms, to change the location of recombination within the device and thereby change the color of light emitted by the device. Thus, the recombination zone may be moved between regions of the OLED, which then may cause different emissive materials to predominantly emit within the OLED. For example, in a device having two EMLs, a first waveform may be applied that causes recombination to occur primarily or exclusively within the first of the two EMLs. A second waveform then may be applied to move some or all of the recombination within the device to the second EML. Where the EMLs include materials that emit light of different colors, this change will cause the ultimate color of light emitted by the device to change as well. Thus, the color output of the device may be modified solely by applying different pulsed mode waveforms. Similarly, the structure of the device may be selected in advance and matched to one or more waveforms, to allow for a range of colors to be emitted. For example, a device structure may be selected that has multiple emissive regions or areas that will produce light of different color. Concurrently or consecutively, appropriate waveforms may be selected that will move the primary recombination zone or zones between the emissive regions. The waveforms may be selected based upon the specific structure of the device, or may be determined by operating the device or an equivalent device using various DC and/or pulsed modes and observing the change in light emitted by the device. Specific examples of device structures and waveforms are disclosed herein. According to some embodiments, additional structural variations may be used. For example, one or more color filters or other color altering layers may be used in combination with the techniques disclosed herein, so as to obtain acceptable or desirable color purity. Such a configuration may be desirable in configurations in which the color obtained from a particular waveform is not a specific desired color. Such a configuration also may be used with white devices with color filters.

Figure 17:
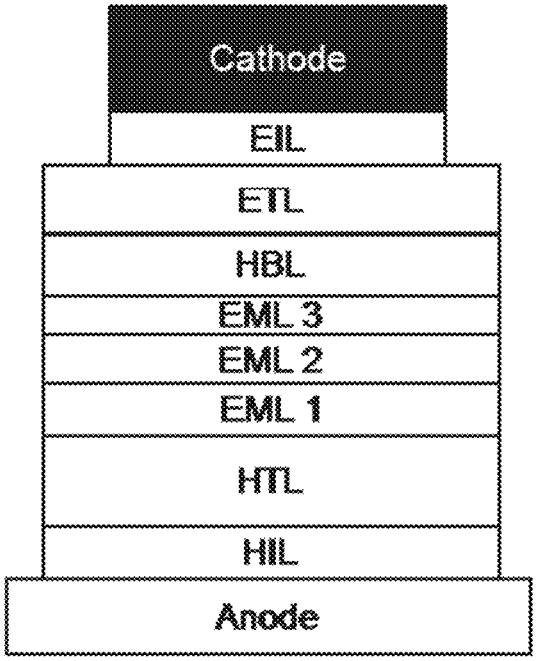
FIG. 17 shows an example schematic representation of a multi-EML color-tunable OLED device structure according to an embodiment.

FIG. 17 shows an example of a device structure having several EMLs with different colors, such as red, green, and blue (R, G, B). The recombination zone within the device EML may be moved by applying different drive modes as previously described, so the position or profile of the RZ within the device EMLs can be used to tune the device emission color. For example, if the RZ is mostly in the proximity of the red EML, then the predominant color emitted by the device may be red. When a different waveform is applied that results in the RZ moving to the proximity of the green EML, then the predominant color emitted by the device may be green.

Figure 18:
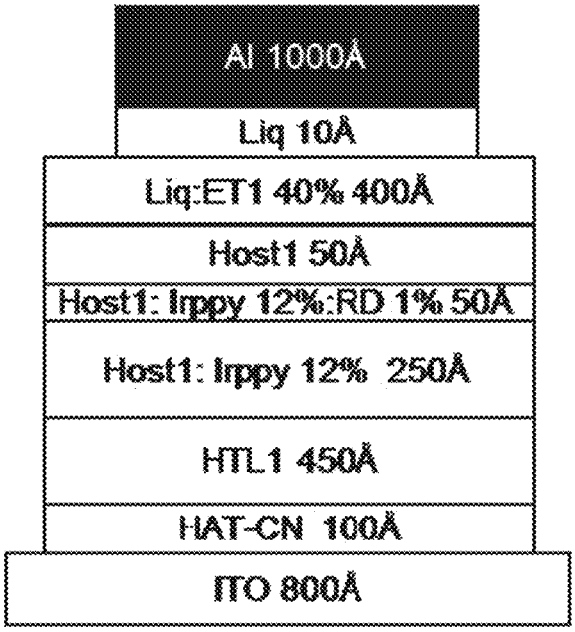
FIG. 18 shows an example of a R-Y-G color tunable 2 EML R-G OLED device structure according to an embodiment.
Figure 19:
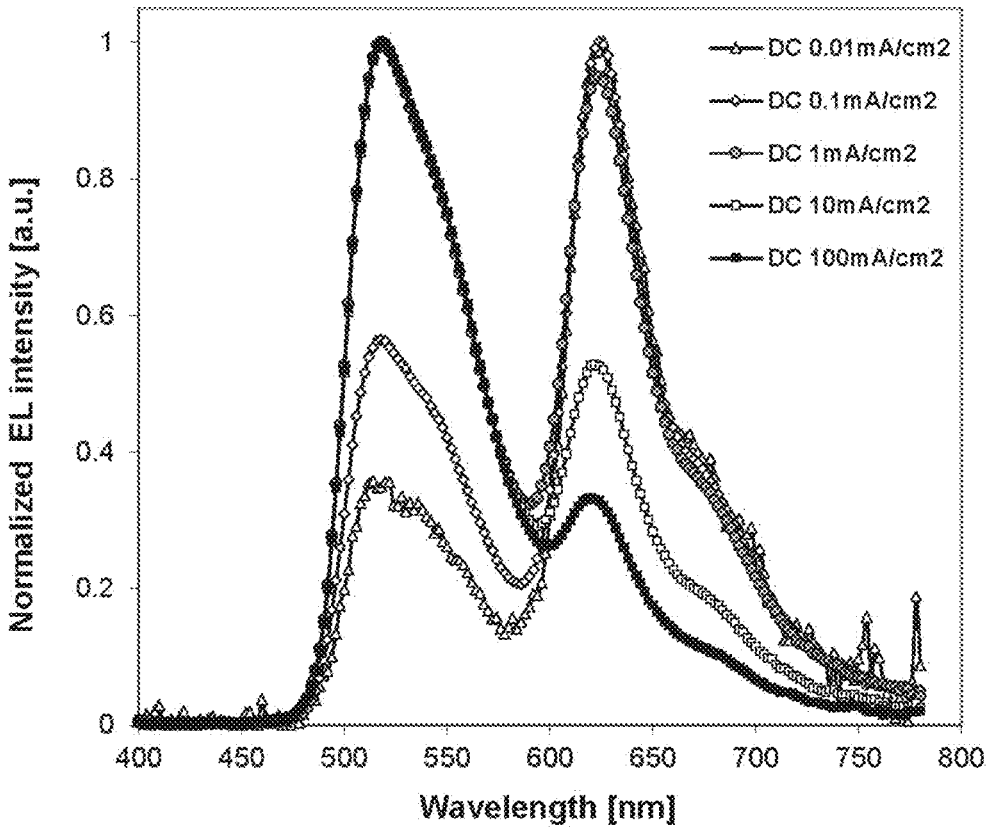
FIG. 19 shows normalized EL spectra of an example of R-Y-G color tuning by current density variation in a DC mode for a 2 EML OLED device structure according to an embodiment.

As a specific example, FIG. 18 shows an illustrative two-EML green-red (G-R) device structure that includes 250 Å of a green EML positioned adjacent to a hole transporting layer (HTL), and 50 Å of a red EML positioned next to a blocking layer (BL). FIG. 19 and Table 7 show the emission of the device driven at various DC mode current densities ranging from 0.01 to 100 mA/cm$^2$. The RZ profile/position changes as a function of the driving current, and thus the color of the device can be tuned from red (at low current density) to orange, to yellow, to green (at high current density). In this device structure, at a low current density (e.g., 0.01 mA/cm$^2$) the RZ is mostly located next to the blocking layer in the red EML (i.e., the interface with a 50 Å host 1 layer) so the color of the device is predominantly red. With increasing luminance and current density, the RZ migrates and/or the recombination profile broadens toward the HTL side. Thus, increasing emission from the green EML is observed and the color of the device at high current density (e.g., 100 mA/cm$^2$) is predominantly green. Similarly, orange and yellow emissions can be achieved at intermediate current densities.

As previously disclosed, color tuning by applying a variable current density in a DC driving mode may result in the device luminance changing in addition to the color emitted by the device being changed. Thus, it may not be practical to use such a technique to change the color in a display due to potentially dramatic differences in luminance when the display emits a different color. For a display to maintain the same color over a wide luminance range, it may be desirable for the display to have many levels of grey scale available.

Figure 20:
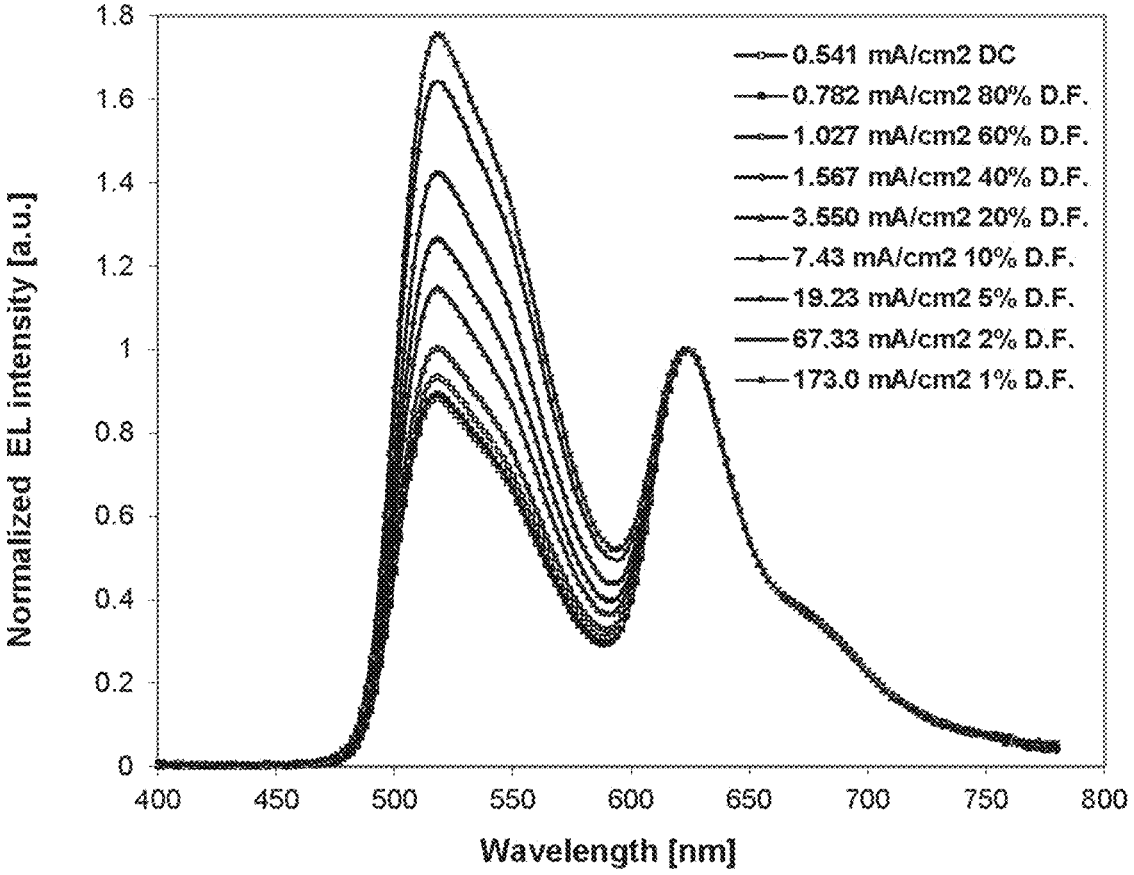
FIG. 20 shows example normalized plots of R-Y-G color tuning by variation of driving conditions between DC and pulsed modes at the same radiance for a 2 EML OLED device structure according to an embodiment.

Driving a device in a pulsed mode with variable momentary current density and variable duty factor as previously disclosed may solve this issue, i.e., allow the color of the device to be tuned by variation of momentary current density, while the integrated visible device luminance is kept the same by manipulating the duty factor. FIG. 20 and Table 8 show color tuning of the same example device driven between DC and pulsed modes. The radiance of the devices is shown to be the same, whereas the color can be changed from orange to yellowish green. Thus, surprisingly, it is possible to change the color emitted by a device without causing a visible change in the luminance of light emitted by the device.

This technique allows for the same integrated luminance in a pulsed mode to be achieved by various driving methods, such as DC or pulsed mode, with various momentary current density and duty factor values. Increasing the momentary current density and decreasing the duty factor can result in the same device radiance, as illustrated by the data shown in Table 8. Thus, the device may be driven at a device at high current density, which results in changing the RZ within the device EML and emitting a different color, while not increasing or controlling the overall device radiance. Notably, the measured luminance shown in Table 8 changes due to changes in the emitted spectrum; however, the radiance (total emission energy from the device) and photon count stays nearly constant.

Figure 21:
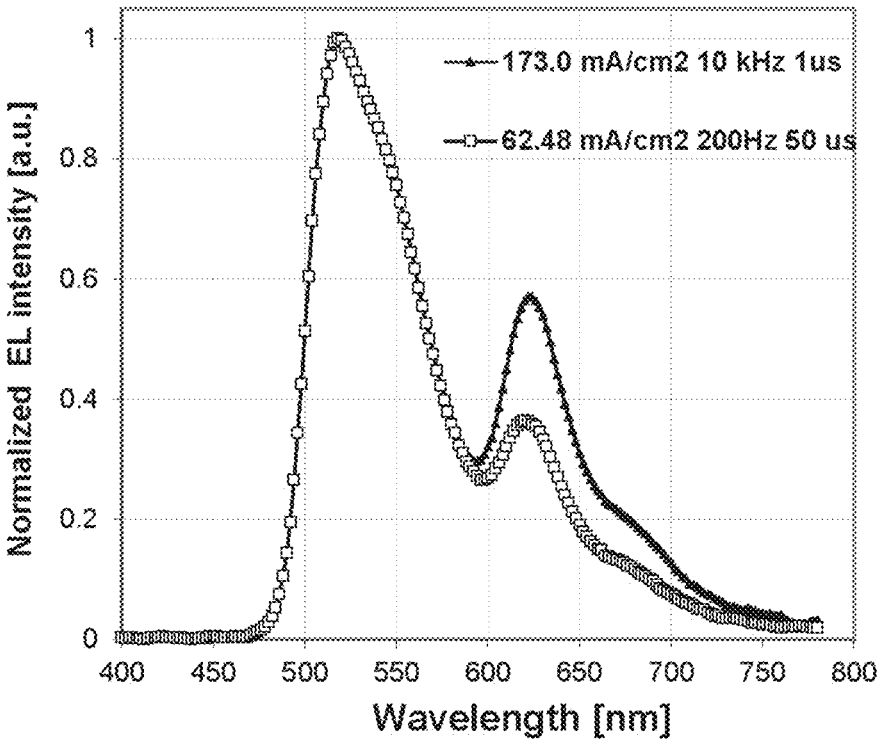
FIG. 21 shows normalized EL spectra of an example of R-Y-G color tuning by variation of driving conditions including pulse width and frequency at a similar radiance and luminance and the same duty factor for a 2 EML OLED device structure according to an embodiment.

As another example technique, a device may be driven using a pulsed mode with a variable frequency and pulse width waveform. FIG. 21 and Table 9 show an example in which the same two-EML device is color tuned by driving it in a pulsed mode with a variable pulse width and frequency. Surprisingly, it has been found that the same radiance (luminance) can be achieved by combination of these two parameters, i.e., a low frequency and wide pulse, and a high frequency and narrow pulse.

Color tuning by this method may be explained by the EL spectrum time response for certain structures. When a voltage is applied to the device, the emission starts at the ETL interface and then propagates inside the EML toward the HTL interface. For a narrow pulse width such as 1 μs (i.e., a short emission time), the majority of recombination occurs in the red part of the EML next to the blocking layer. At a wide pulse width, such as 50 μs (i.e., a long emission time), the recombination zone has sufficient time to shift to the green part of the EML toward the HTL interface. As a result, predominantly green emission is observed for a 50 μs long pulse, and more red emission is observed with a narrow pulse width, as shown in Table 9.

With the multi-EML OLED device operated in a pulse mode, the time constants of various regions of device recombination profile can be very different. The shape of the pulse of light coming from different sections of the device can vary in terms of the pulse rise and the fall times. Knowing the device time response characteristics allows the utilization of another mechanism to control the output color. For example, if the rise or fall time of the red emission is longer from that of a green component, the color change can be achieved by changing the pulse width, promoting faster or slower components. This time-resolved color change may cause a change of the overall brightness, which can then be corrected by other parameters of the waveform, such as amplitude or frequency. An electronic driving circuit can be used to provide the necessary modifications of the waveform on demand of the user, a display input, based upon a provided input or configuration signal, or the like.

Figure 22:
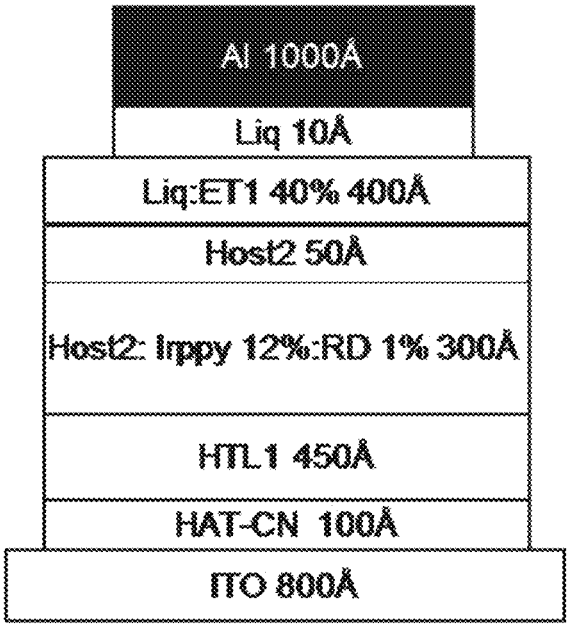
FIG. 22 shows an example of a R-Y-G color tunable 1 EML OLED device structure including emitters with various transient decay times according to an embodiment.
Figure 23:
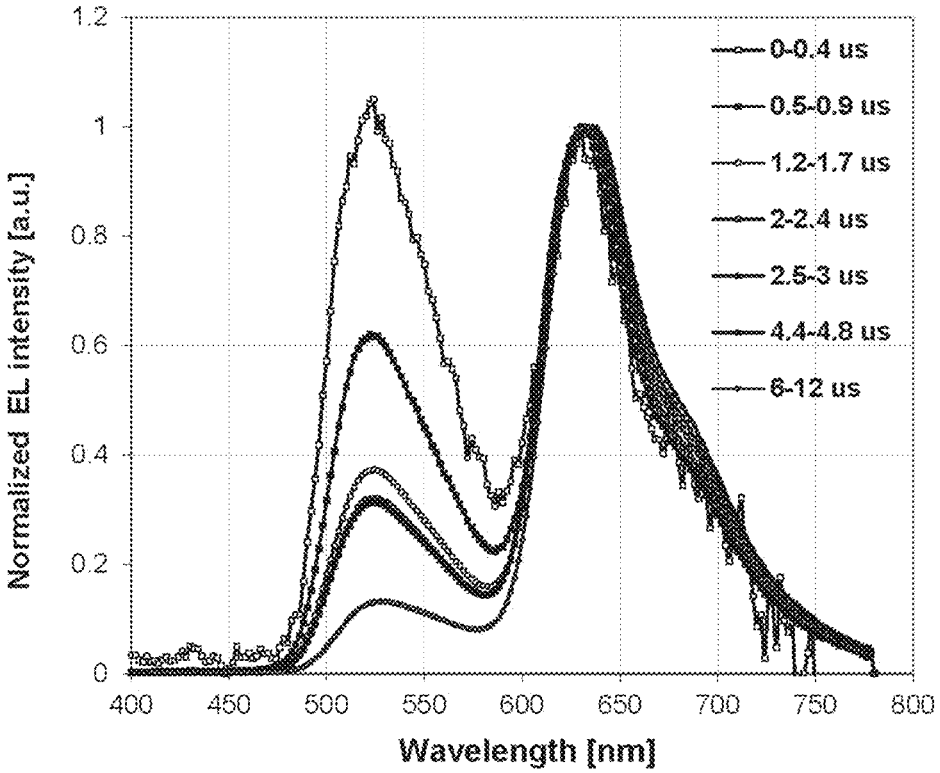
FIG. 23 shows an example time resolved EL spectrum of a 1 EML R-Y-G color tunable OLED driven with a 6 μs pulse width at 10 kHz, with a momentary voltage of 10V and momentary current density of 136 mA/cm$^2$ according to an embodiment, which demonstrates the time dependence of the device emission color.
Figure 24:
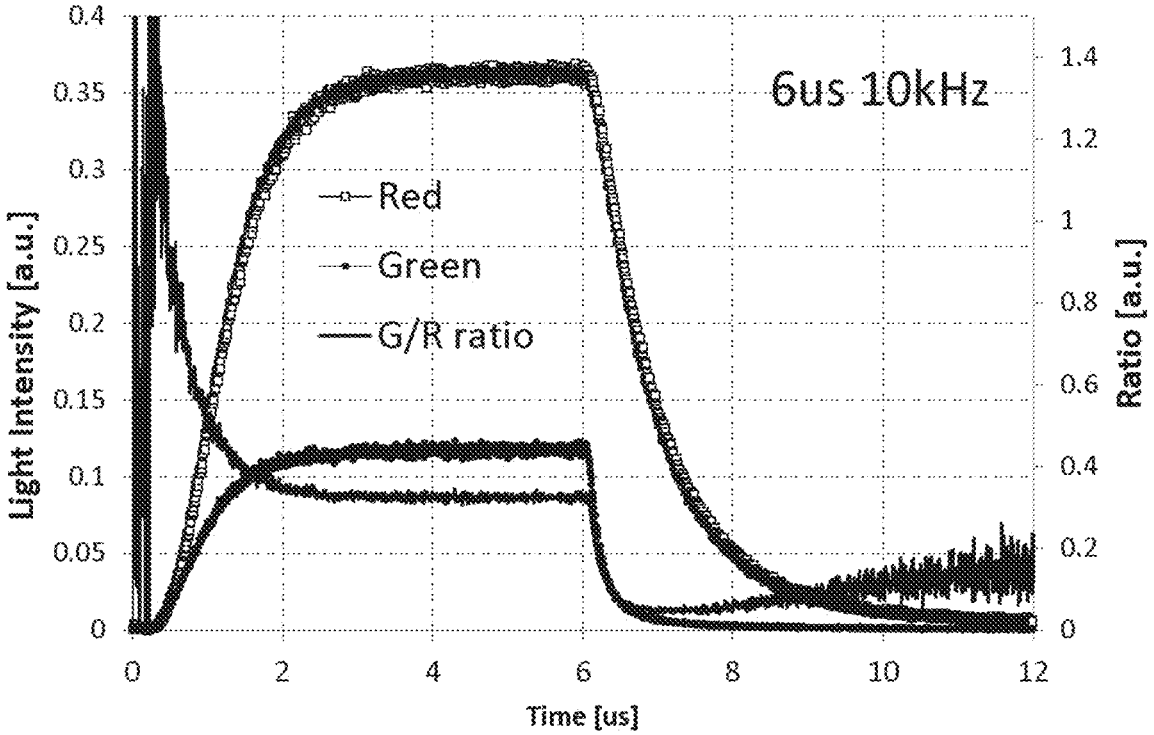
FIG. 24 shows example time resolved EL red and green intensities and G/R ratio of a 1-EML color-tunable OLED driven at a 6 μs pulse width, 10 kHz, momentary voltage 10V, and momentary current density 136 mA/cm$^2$ according to an embodiment, from which a suitable waveform to apply to enhance a given color may be determined.

As another example, a device having multiple emitters may be color tuned using the techniques disclosed herein. An example schematic structure of such a device is shown in FIG. 22. The example device contains 2 emitters: Green Irppy with a transient time of about 840 ns (the EL transient time in a monochrome device) and red RD1 with about a 2.3 μm transient fall time (the EL transient time in a monochrome device). FIG. 23 and Table 10 show the time resolved EL spectra, and FIG. 24 and Table 11 show the R/G intensity of the device. When a pulse is applied (rise of the EL), the green emission (fast emission component) dominates in the device EL. When the pulse is stopped (decay of the EL), the red (slow component emission) dominates in the device EL. Table 11 shows the integrated red and green intensity in the EL rise, steady state and decay. The rise time for the example system is up to 2 μs, followed by steady state operation, and the decay time is up to 6 μs upon pulse termination. Due to the fast rise and slow decay, the decay emission contribution is more significant in comparison to the rise emission in the case of a very short pulse. The shorter the pulse, the more contribution of the decay emission into total integrated device emission can be achieved. So the red (slow component) emission may be enhanced by shortening the pulse width, and the green (fast component) emission may be enhanced by using a long pulse with a longer steady state emission relative to the decay emission.

Figure 25:
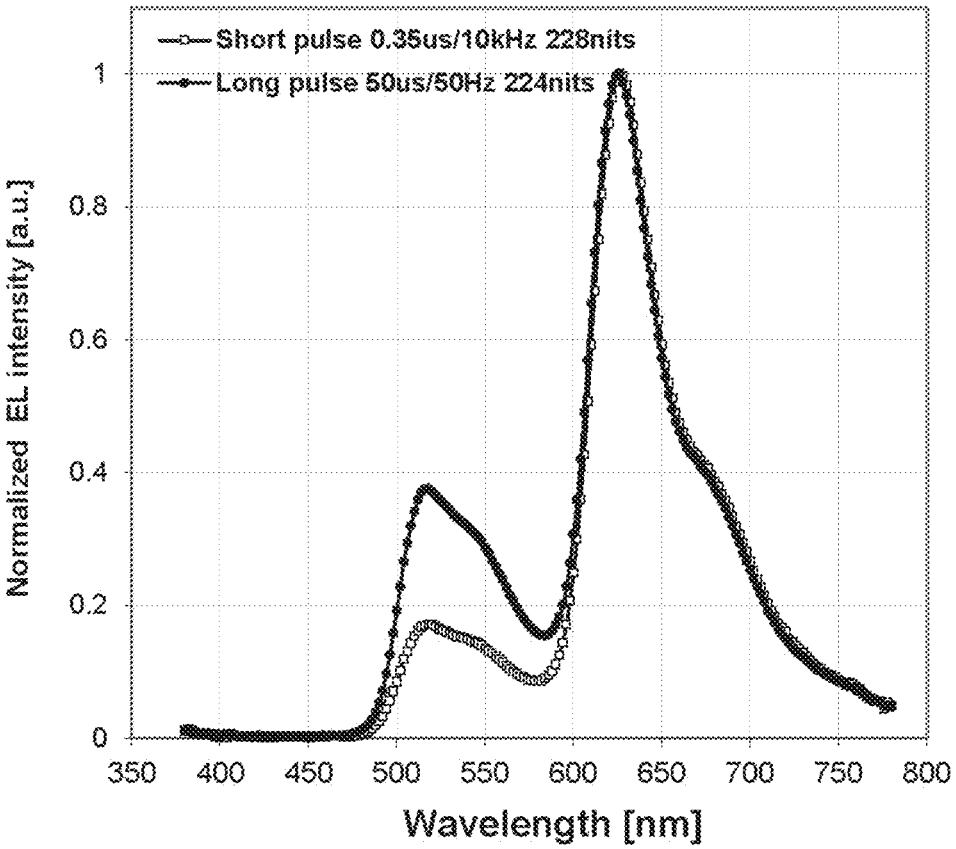
FIG. 25 shows an example of an integrated, normalized R-Y color spectrum for a 1-EML color-tunable OLED driven with different pulse width to frequency ratio at the same integrated luminance according to an embodiment.

FIG. 25 and Table 12 show examples of integrated EL at the same luminance with different colors. The device driven at shorter pulses, e.g. 0.35 its, show more red emission. The device driven at a longer pulse, e.g. 50 its, shows more green emission. The same luminance is achieved by tuning the frequency and duty factor as previously disclosed.

Figure 26:
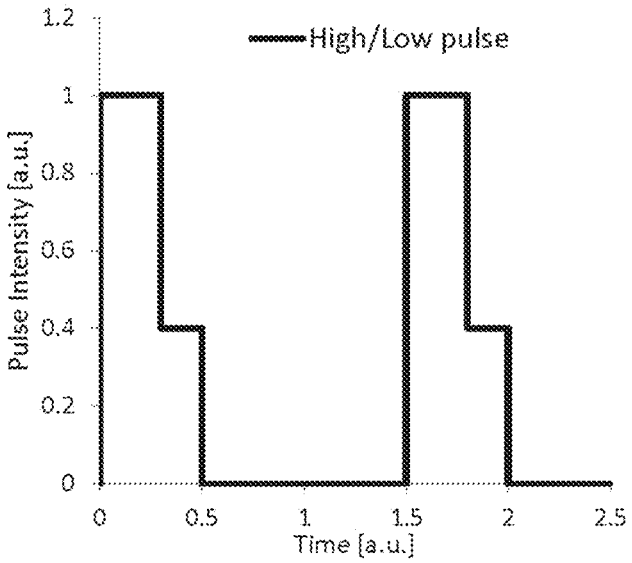
FIG. 26 shows examples of pulse waveforms to enhance faster (green) emission in a 1 EML color tunable device according to an embodiment.
Figure 26:
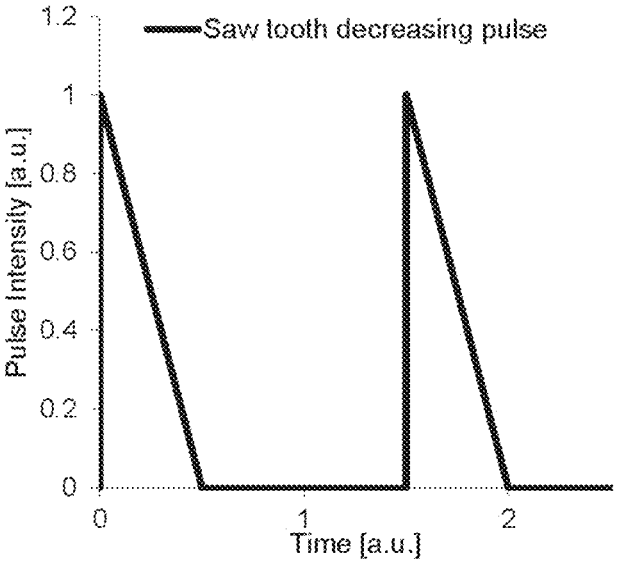
Figure 27:
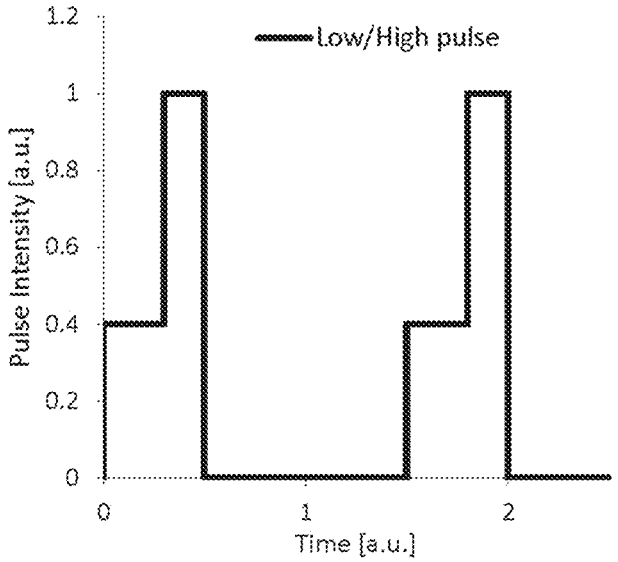
FIG. 27 shows examples of pulse waveforms to enhance slower (red) emission in a 1 EML color tunable device according to an embodiment.
Figure 27:
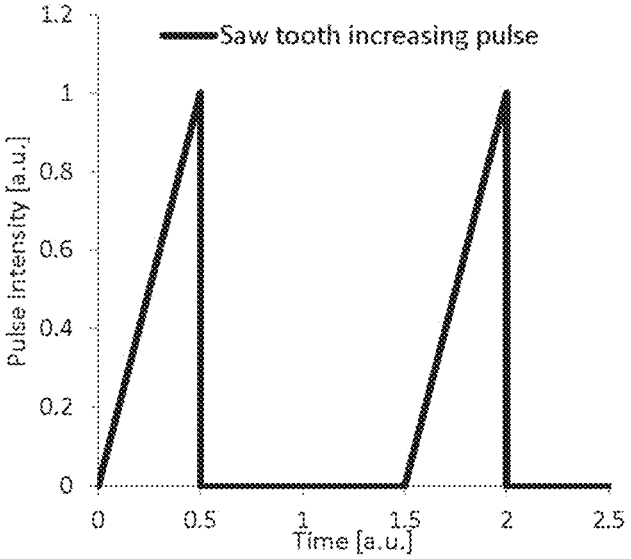

FIGS. 26 and 27 show examples of pulse shapes suitable to enhance the slow or fast component of emission in an example device as previously described. FIG. 26 shows examples of a gradual or stepped pulse decreasing the pulse intensity at the end of the pulse, which results in reducing the slow component (red) decay emission contribution due to supplying additional fast component emission from the steady state while intensity decays. In this case the contribution of the fast (green) emission component is enhanced. The waveforms shown in FIG. 26 are illustrative only. More generally, multiple steps may be used, or a different shape than a saw tooth pattern may be used, though it may be preferred that the pulse shape starts on average with a high pulse intensity, and then has a slope to a lower pulse intensity.

Enhancement of a slow emission component, such as a red emissive component, can be achieved with a gradual or stepped increase pulse to suppress the fast emission in the pulse rise, which improves the conditions for the decay component of the emission which is predominantly slow emission. In this way the slow emission contribution may be enhanced, as shown in FIG. 27, which illustrates example pulsed mode waveforms suitable for enhancing slower emission components. The waveforms shown in FIG. 27 are illustrative only. More generally, multiple steps may be used, and/or a different shape than a saw tooth pattern may be used, though it may be preferred that the pulse shape starts on average with a low pulse intensity and then slopes to a higher pulse intensity.

As previously indicated, when color tunable OLED devices are used in a display application such as a full-color display, it may be preferred that the display device can be driven at the same color at several grey scales, i.e., at various brightness levels. This may be achieved by using multiple device structures with different driving schemes including variation of momentary current density, frequency, pulse width, duty factor as disclosed herein. Two examples below describe the same device driven with variable luminance levels maintaining the same color.

Figure 28A:
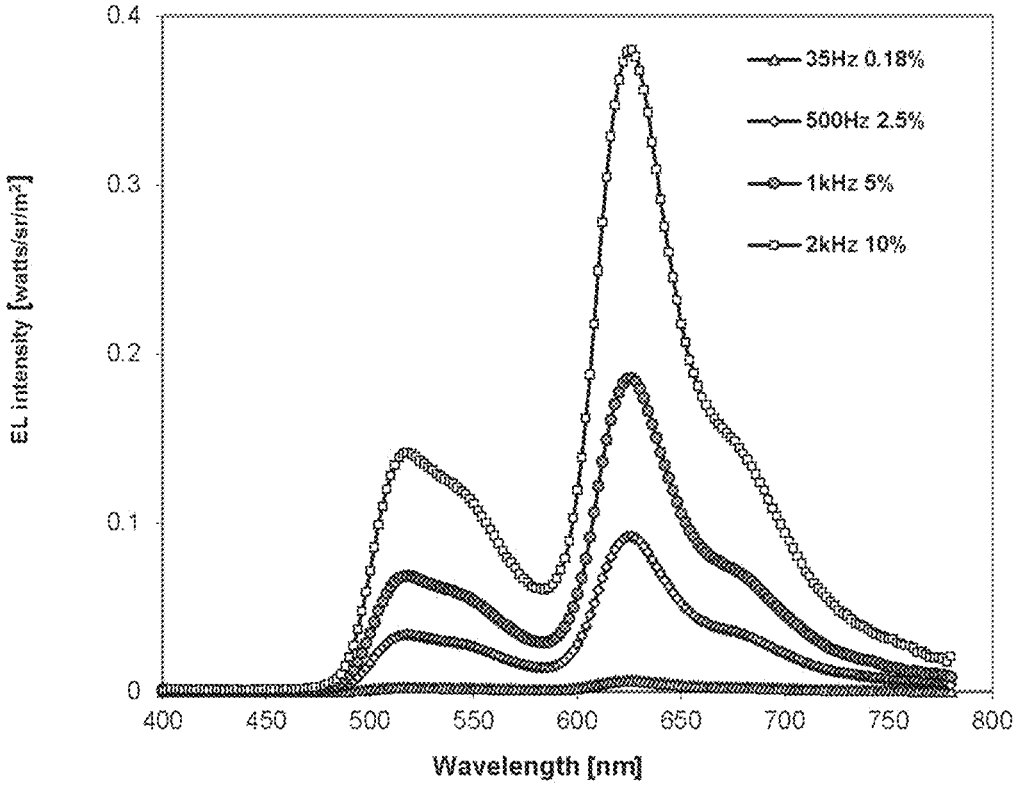
FIGS. 28A-28C show examples of the luminance variation while maintaining a constant yellow color for 1 EML color tunable OLED according to an embodiment.
Figure 28B:
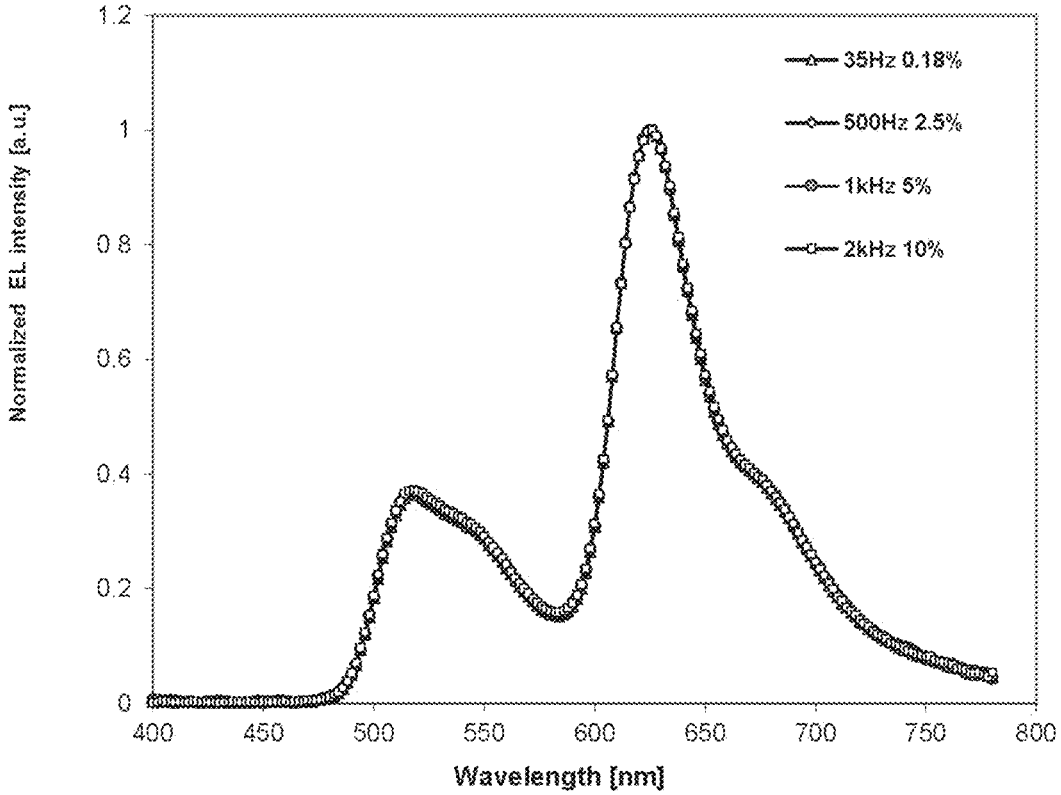
Figure 28C:
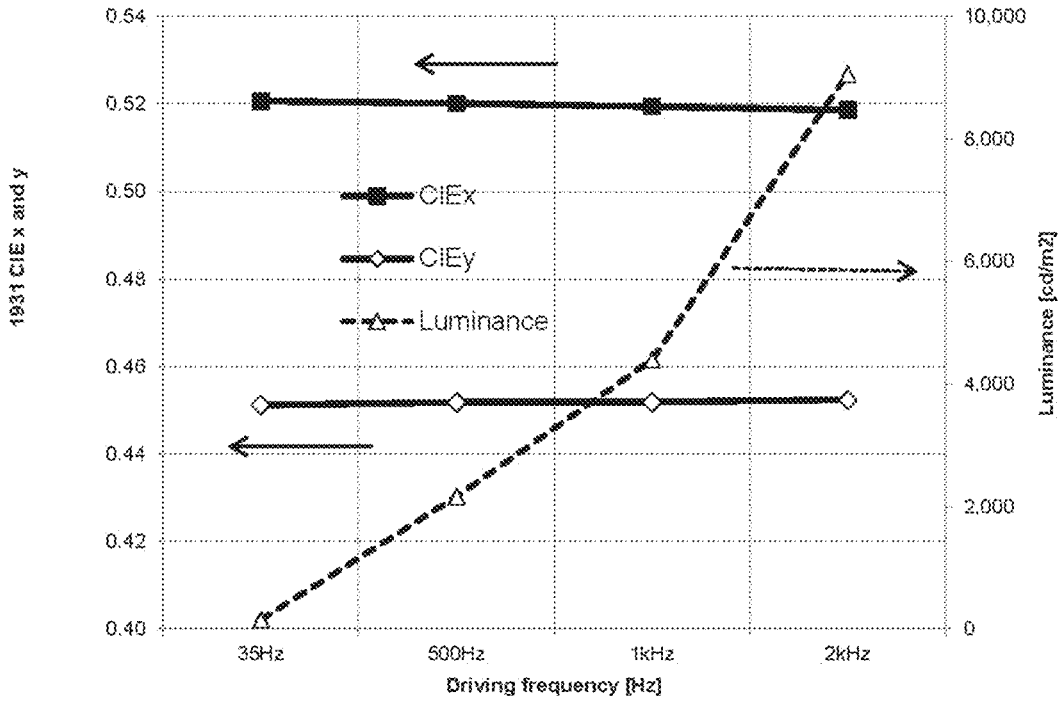
Figure 29A:
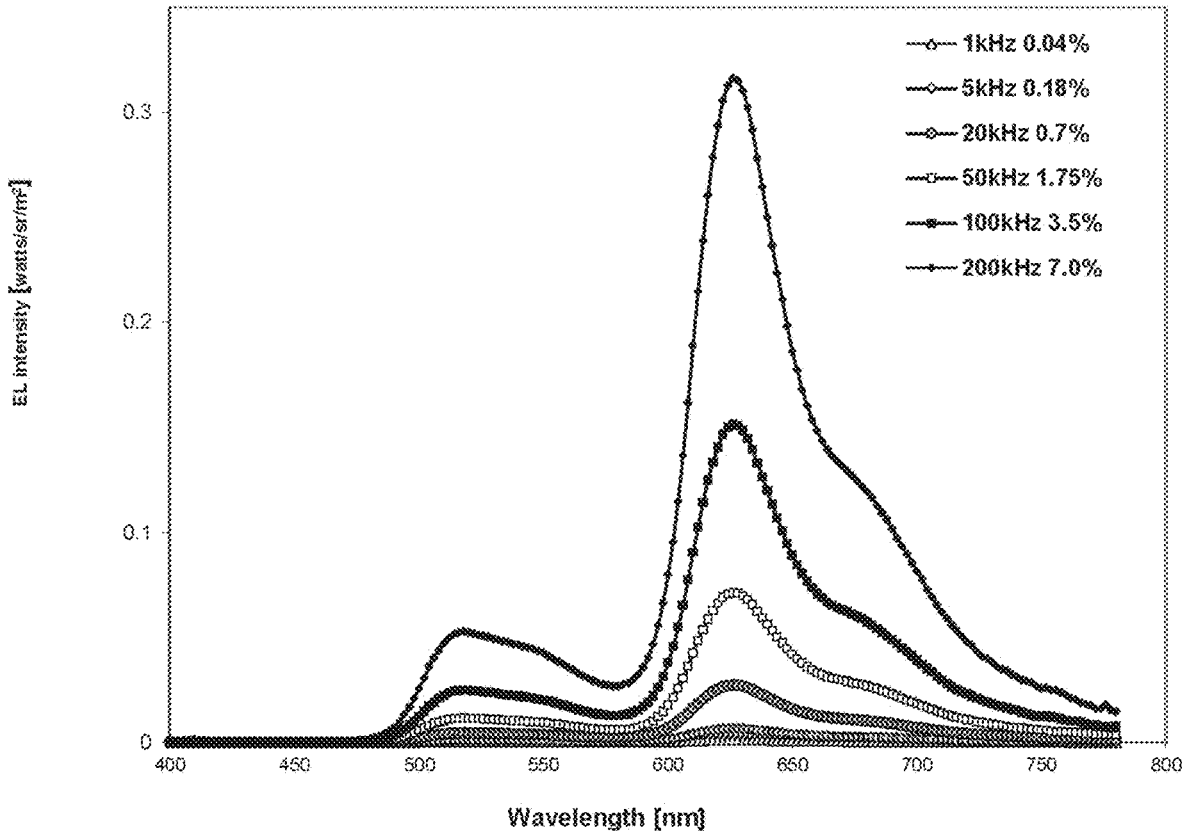
FIGS. 29A-29C show examples of luminance variation while maintaining a constant predominantly red color for a 1 EML color tunable OLED according to an embodiment.
Figure 29B:
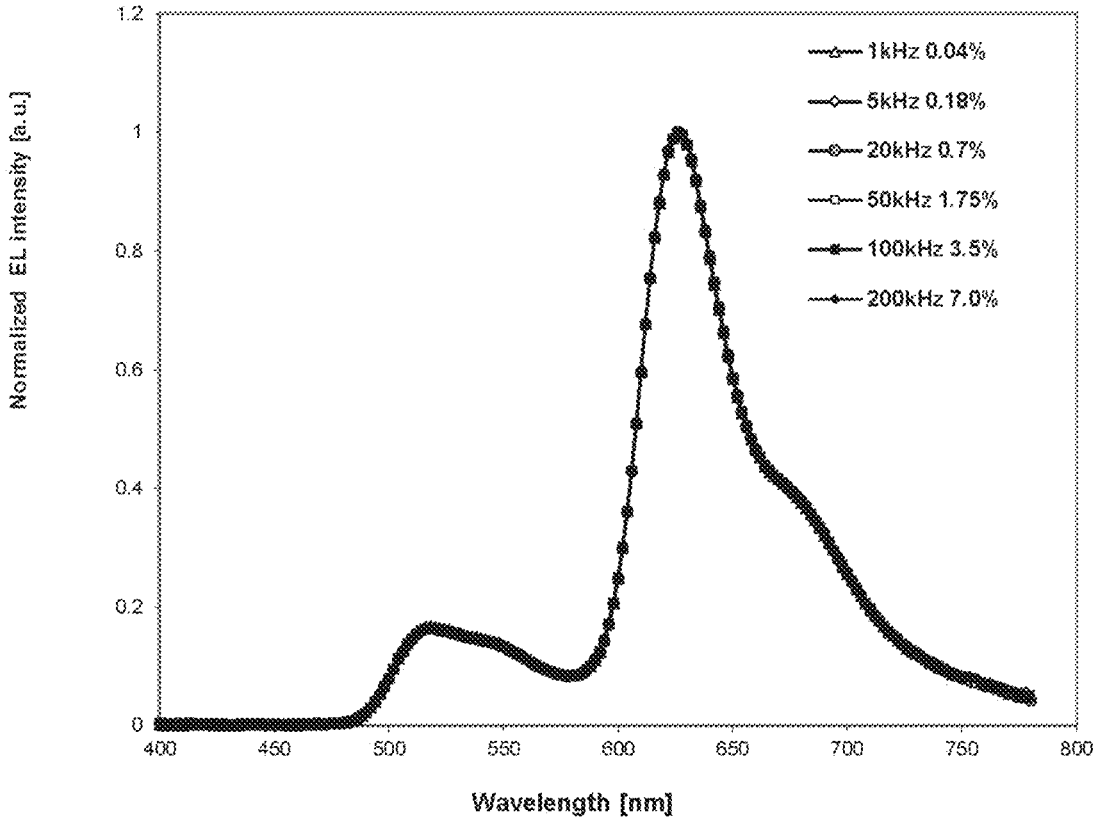
Figure 29C:
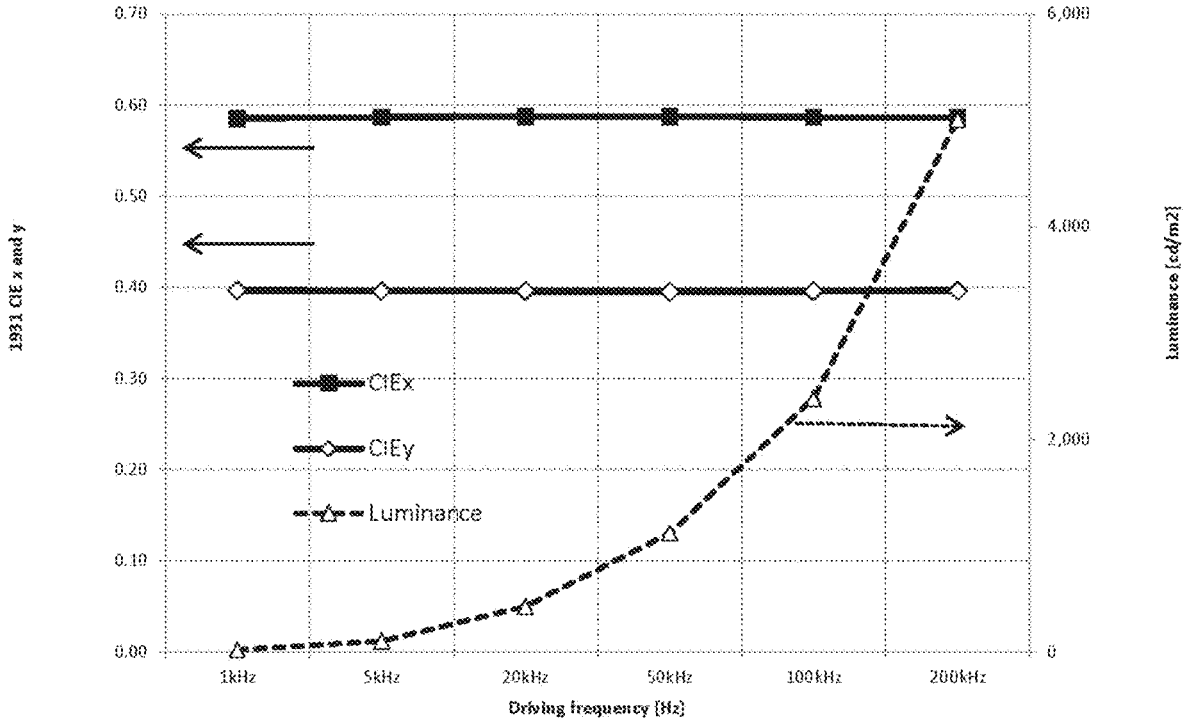

FIGS. 28-29 and Tables 13-14 illustrate luminance variation while maintaining a constant color for a one-EML, color-tunable device, such as a device having the structure shown in FIG. 22. FIG. 28A shows the absolute spectra; FIG. 28B shows the normalized spectra; and FIG. 28C shows the CIE and luminance as functions of the driving conditions. FIG. 29 shows examples of luminance variation while maintaining a constrained color for a one-EML OLED. FIG. 29A shows the absolute spectra; FIG. 29B shows the normalized spectra; and FIG. 29C shows the CIE and luminance as functions of driving conditions. As previously described, in this example the pulse width defines the emission color of the device. A 50 μs pulse width results in a predominantly green-yellow emission, and a 0.35 μs pulse results in predominantly red emission. In order to change the luminance, the driving frequency and duty factor may be changed within 35 Hz to 2,000 Hz, and 0.18% to 10% duty factor for a 50 μs pulse yellow emission, which provides a luminance variation of 152-9,058 cd/m$^2$. Similarly, the driving frequency and duty factor may be changed within 1 kHz to 200 kHz, and 0.04% to 7% duty factor for a predominantly red emission 0.35 μs pulse, which provides a luminance variation of 20-5,010 cd/m$^2$. As shown, both modes may be obtained from the same device. Thus, as illustrated in FIGS. 28A-C, a constant pulse width may be used to define a constant color, with variations in frequency and duty factor allowing for luminance variations and thus many levels of grey scale, suitable for use in a display.

Figure 30A:
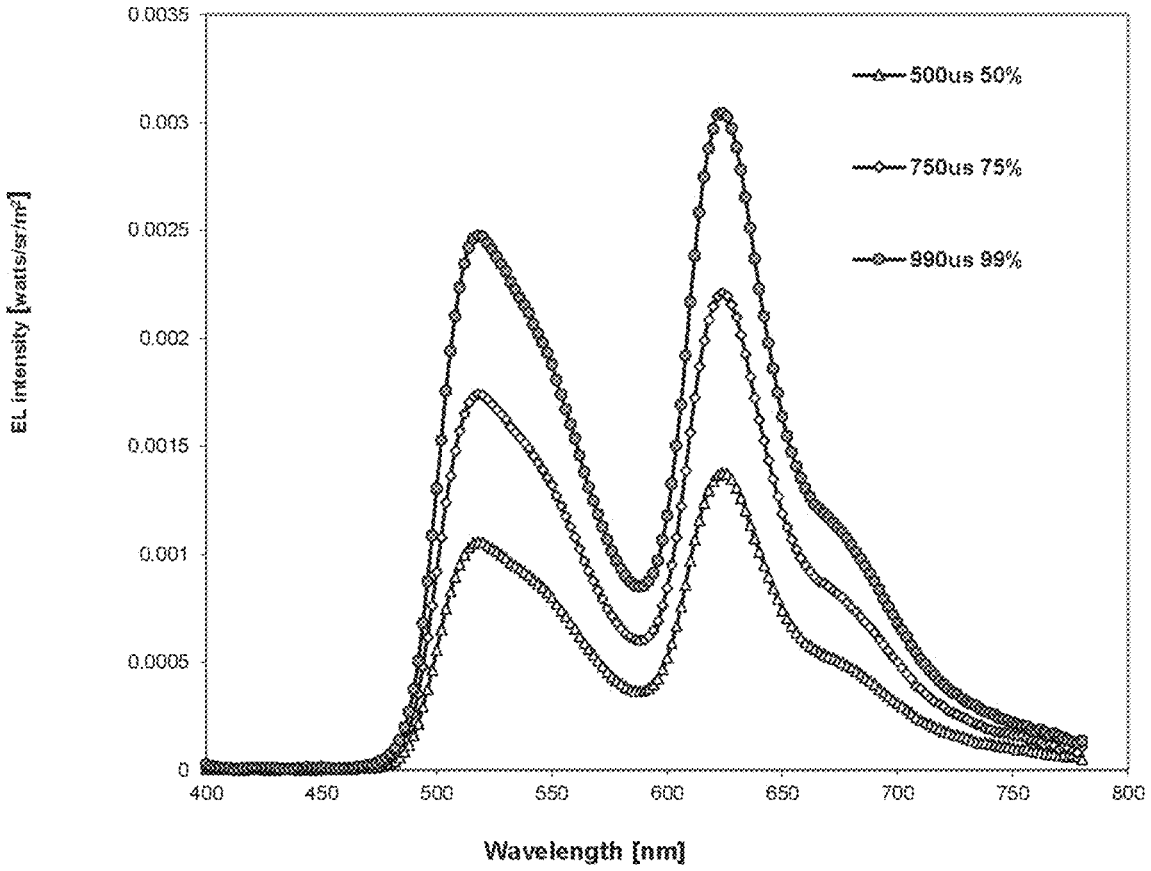
FIGS. 30A-30C show examples of luminance variation while maintaining a constant yellow color for a 2 EML color tunable OLED according to an embodiment.
Figure 30B:
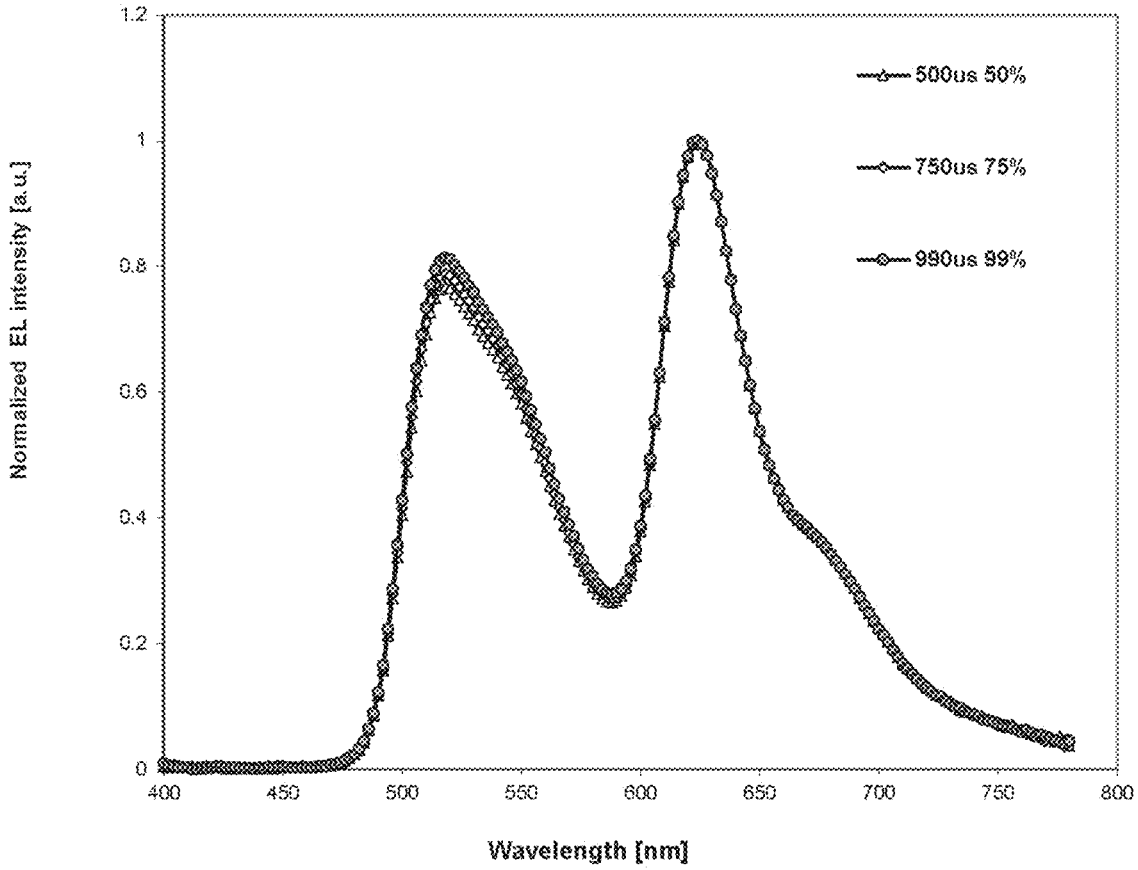
Figure 30C:
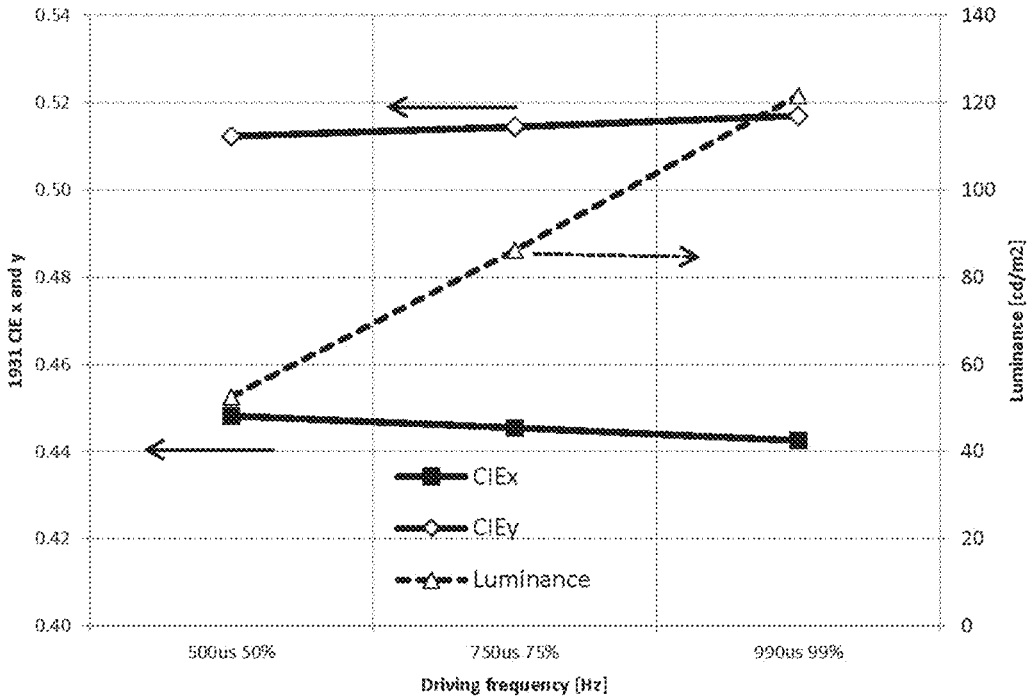
Figure 31A:
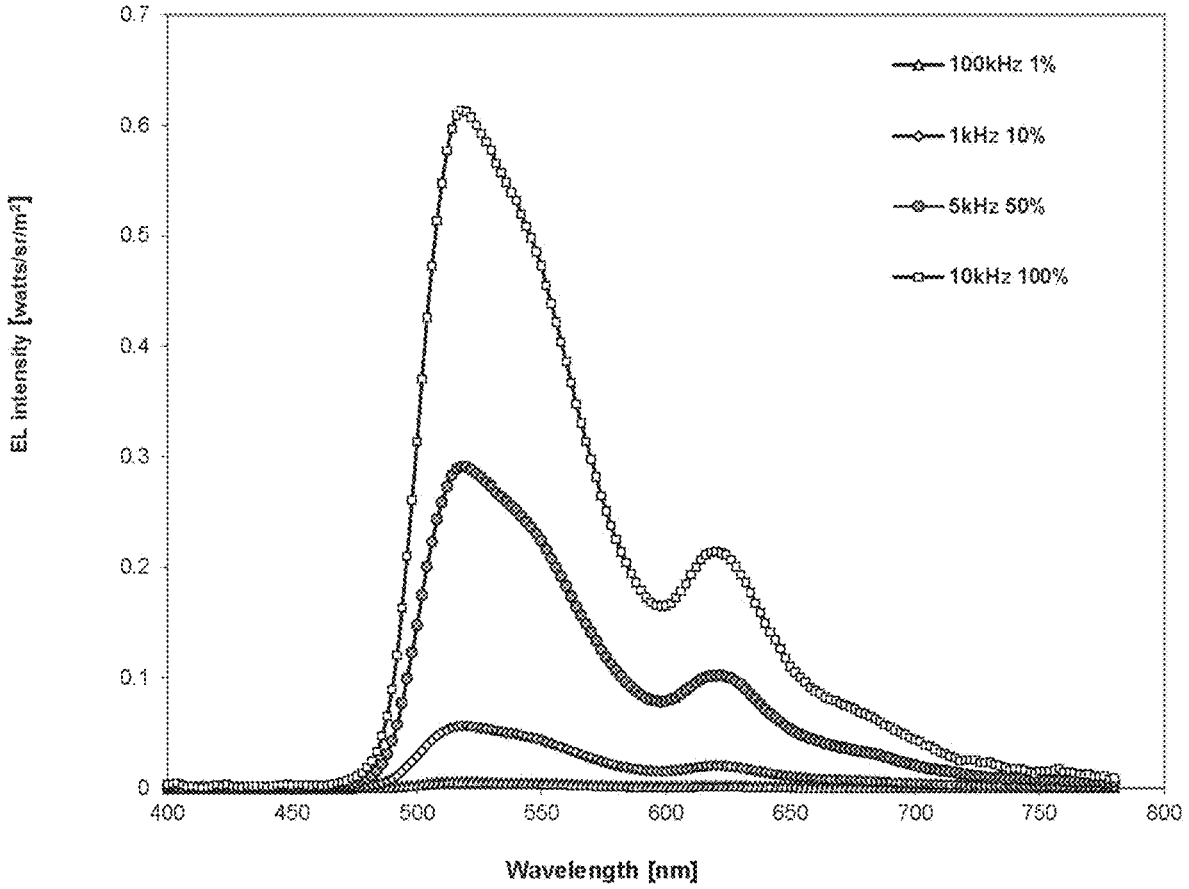
FIGS. 31A-31C show examples of luminance variation while maintaining a constant predominantly green color for a 2 EML color tunable OLED according to an embodiment.
Figure 31B:
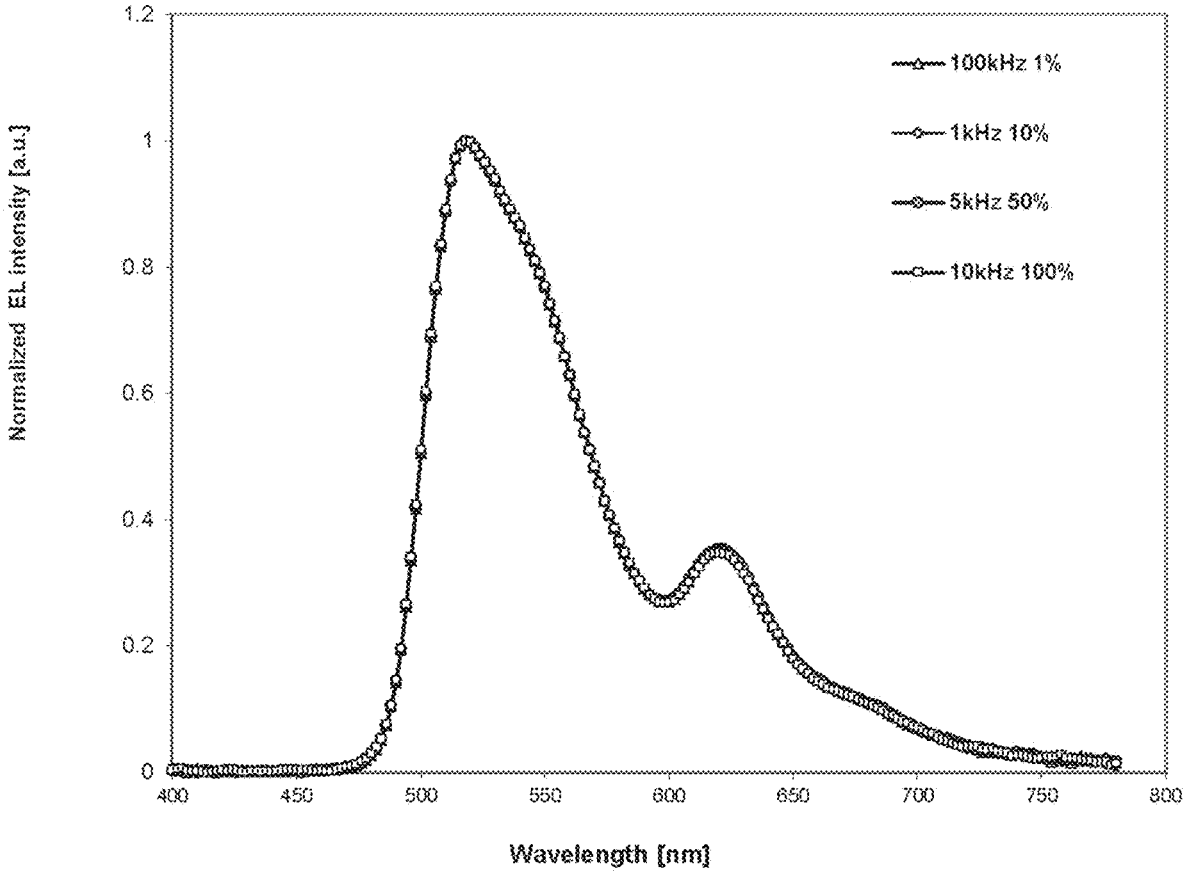
Figure 31C:
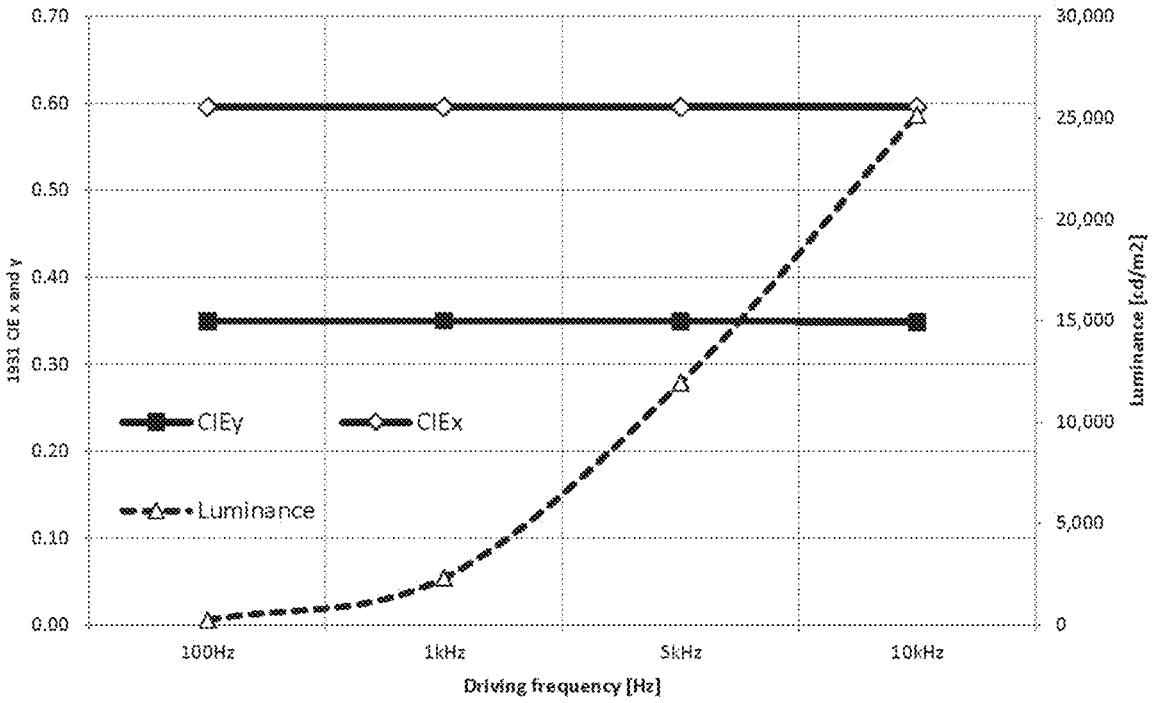

FIGS. 30-31 and Tables 15-16 illustrate luminance variation while maintaining a constant color for a two-EML, color-tunable device as disclosed herein, such as an OLED having the structure shown in FIG. 18. FIGS. 30A-30C and 31A-31C show the absolute spectra, normalized spectra, and CIE and luminance as functions of the driving conditions, respectively. As previously described, the momentary current density defines the emission color of the device. In the example, a current density of 0.3933 mA/cm$^2$ results in predominantly yellow emission, and a current density of 61.11 mA/cm$^2$ results in predominantly green emission. To change the luminance, the driving duty factor and pulse width can be changed within a 50% to 99% duty factor and a 500 μs to 750 μs pulse width for a momentary current density of 0.3933 mA/cm$^2$ for yellow emission, which provides luminance variation of 53-122 cd/m$^2$. Similarly, to change the luminance, the driving duty factor can be changed within 1% to 100% with a constant pulse width of 100 μs for a 61.77 mA/cm$^2$ momentary current density, predominantly green emission, which provides luminance variation of 225-25,160 cd/m$^2$. As shown, both modes may be achieved for the same device. As illustrated by FIGS. 30 and 31, the luminance of a two-EML, color-tunable device may be changed while maintaining the same color.

Ranges and parameters other than those used in the specific illustrative examples may be used. For example, momentary current densities may be used in the range of from 0.1-1,000 mA/cm$^2$. Frequencies of 20 Hz to 1 MHz may be used for phosphorescent OLEDs, and 20 Hz to 1 GHz for fluorescent devices. Pulse widths of 0.1 to 1000 μs may be used for phosphorescent OLEDs and 0.1 ns to 1000 μs for fluorescent devices. Duty factors of 0.01% to 100% may be used. Specific illustrative ranges include momentary current densities in the range of 0.39 to 753 mA/cm$^2$, frequencies in the range of 35 Hz to 200 kHz, pulse widths of 0.35 to 990 μs, and duty factors of 0.04 to 100% may be used.

Although many examples disclosed herein are described in terms of a full-color display that includes OLEDs as, for example, pixels and sub-pixels, it will be understood that the principles, techniques, and arrangements apply equally to lighting applications where it may be desirable to adjust the color and/or luminance in a similar device. For example, an OLD lighting panel may use the techniques disclosed herein to adjust luminance and/or color, such as to achieve a longer lifetime. In applications that do not inherently include a frame time, frame times may be used that correspond to a desired frequency of pulsed mode signals. As a specific example, a continuously-lit lighting panel may be operated in a pulsed mode at a frequency of 60 Hz, 80 Hz, 120 Hz, or the like, or at any other suitable frequency, even though the panel may not be configured to display a video or other signal that includes such a frequency.

TABLE 1

Different driving conditions to obtain the same apparent luminance of the device. Device structure described in Table 4.

| Driving conditions | Voltage [V] | Momentary Luminance [cd/m$^2$] | Apparent luminance [cd/m$^2$] | Luminous efficacy [cd/A] |
|---|---|---|---|---|
| DC | 3.45 | 1220 | 1220 | 59.3 |
| Pulsed 1000 Hz 20% duty factor | 4.29 | 6100 | 1220 | 53.6 |

TABLE 2

Relative loss of luminous efficacy as a function of operating luminance. Device structure described in Table 4.

| | Luminance [cd/m$^2$] | | |
|---|---|---|---|
| Parameter | 1,000 nits | 10,000 nits | 30,000 nits |
| LE of non-aged device [cd/A] | 59.7 | 50.9 | 43.4 |
| LE of aged device [cd/A] | 48.9 | 43.9 | 38.2 |
| LE drop upon same aging [%] | 18.1 | 13.8 | 12.0 |

TABLE 3

Luminous efficacy gain in lower luminance range due to different driving modes. Device structure is described in Table 4. Gain in luminous efficacy in aged devices operated in low luminance range (100-1000 cd/m$^2$)

| Driving conditions | Peak Luminance [cd/m$^2$] | Apparent luminance [cd/m$^2$] | Luminous efficacy [cd/A] |
|---|---|---|---|
| DC | 100 | 100 | 47.1 |
| Pulsed 1000 Hz 20% duty factor | 500 | 100 | 49.1 |

TABLE 4

Detailed device structure and materials for experiments described in Tables 1, 2, 3.

| Layer | Materials | Thickness and concentration |
|---|---|---|
| Anode | ITO | 800 Å |
| HIL | HAT-CN | 100 Å |
| HTL | HTL1 | 450 Å |
| EML | Host2: Irppy | 15% 400 Å |

TABLE 4-continued

Detailed device structure and materials for experiments described in Tables 1, 2, 3.

| Layer | Materials | Thickness and concentration |
|---|---|---|
| ETL | Liq: ET1 | 40% 350 Å |
| EIL | Liq | 10 Å |
| Cathode | Al | 1,000 Å |

TABLE 5

Driving conditions. Device structure is described in the Experimental section provided herein.

| Device dot | Time | |
|---|---|---|
| frame | 0 to 115 h | 116-160 h |
| Dot 1 | DC 10 mA/cm$^2$ | 27 mA/cm$^2$ momentary J pulsed at 1 kHz with 37% DF |
| Dot 2 | 27 mA/cm$^2$ pulsed at 1 kHz with 37% DF | DC 10 mA/cm$^2$ |

TABLE 6

Summary of the aging experiment described in the experimental section provided herein.

| Step | Time Hours] | Luminance Lo [cd/m$^2$] | 1931 CIE x | 1931 CIE y | LE [cd/A] | PE [lm/W] | Relative luminance [%] |
|---|---|---|---|---|---|---|---|
| Dot 1 DC | 0 | 5434 | 0.3089 | 0.6270 | 54.3 | 28.9 | 100.0 |
| Dot 1 DC | 115 | 5076 | 0.3080 | 0.6276 | 50.8 | 26.9 | 93.4 |
| Dot 1 Pulsed | 116 | 5210 | 0.3093 | 0.6274 | 52.1 | 27.7 | 95.9 |
| Dot 1 Pulsed | 160 | 5182 | 0.3088 | 0.628 | 51.8 | 27.5 | 95.4 |
| Dot 2 Pulsed | 0 | 5430 | 0.3095 | 0.6272 | 54.3 | 29.2 | 100.0 |
| Dot 2 Pulsed | 115 | 5113 | 0.3085 | 0.6273 | 51.1 | 27.0 | 94.2 |
| Dot 2 DC | 116 | 4884 | 0.3070 | 0.6277 | 48.8 | 26.0 | 89.9 |
| Dot 2 DC | 160 | 4807 | 0.3065 | 0.6288 | 48.1 | 25.5 | 88.5 |

TABLE 7

Example of R-Y-G color tuning by current density variation in DC mode for a 2 EML OLED device structure. Device performance. Device structure is shown in FIG. 18.

| DC driving conditions [mA/cm$^2$] | Radiance [W/sr/m$^2$] | Luminance [cd/m$^2$] | 1931 CIE x | 1931 CIE y | λ max [nm] | FWHM [nm] | Emission color |
|---|---|---|---|---|---|---|---|
| 0.01 | 0.0094 | 2.3 | 0.515 | 0.451 | 626 | 46 | Predominantly Red |
| 0.1 | 0.0958 | 27 | 0.478 | 0.486 | 624 | 142 | Orange |
| 1 | 0.94 | 326 | 0.421 | 0.535 | 518 | 150 | Yellow |
| 10 | 9.15 | 3,652 | 0.376 | 0.574 | 518 | 128 | Yellow-Green |
| 100 | 77.45 | 33,760 | 0.347 | 0.597 | 518 | 66 | Green |

TABLE 8

Example of R-Y-G color tuning by variation of driving conditions between DC and pulsed modes at the same radiance for a 2 EML OLED device structure. Device performance. Device structure is shown in FIG. 18.

| Driving conditions | | | | | | | | |
|---|---|---|---|---|---|---|---|---|
| Momentary current density [mA/cm$^2$] | Mode/Duty factor [%] | Radiance [W/sr/m$^2$] | Luminance [cd/m$^2$] | 1931 CIE x | 1931 CIE y | λ max [nm] | FWHM [nm] | Emission color |
| 0.541 | DC/100% | 0.474 | 156 | 0.435 | 0.523 | 624 | 152 | Orange |
| 0.782 | Pulsed*/80% | 0.491 | 162 | 0.434 | 0.524 | 624 | 151 | Orange |
| 1.027 | Pulsed*/60% | 0.487 | 163 | 0.430 | 0.527 | 624 | 150 | Yellow |
| 1.567 | Pulsed*/40% | 0.479 | 163 | 0.424 | 0.533 | 520 | 154 | Yellow |
| 3.550 | Pulsed*/20% | 0.498 | 176 | 0.412 | 0.543 | 520 | 148 | Yellow |
| 7.430 | Pulsed*/10% | 0.488 | 178 | 0.404 | 0.550 | 520 | 145 | Yellow-Green |
| 19.23 | Pulsed*/5% | 0.498 | 187 | 0.394 | 0.558 | 519 | 134 | Yellow-Green |
| 67.33 | Pulsed*/2% | 0.522 | 202 | 0.383 | 0.567 | 518 | 136 | Yellowish Green |
| 173.0 | Pulsed*/1% | 0.506 | 199 | 0.379 | 0.570 | 518 | 134 | Yellowish Green |

*Frequency 10 kHz

TABLE 9

Example of R-Y-G color tuning by variation of driving conditions: Pulse width and frequency at a similar radiance and luminance and same duty factor for a 2 EML OLED device structure. Device performance. Device structure is shown in FIG. 18.

| Pulsed driving conditions | | | | | | | | | | |
|---|---|---|---|---|---|---|---|---|---|---|
| Momentary current density [mA/cm$^2$] | Duty factor [%] | Frequency [Hz] | Pulse width [us] | Radiance [W/sr/m$^2$] | Luminance [cd/m$^2$] | 1931 CIE x | 1931 CIE y | λ max [nm] | FWHM, [nm] | Emission color |
| 173.0 | 1% | 10,000 | 1 | 0.506 | 199 | 0.379 | 0.570 | 518 | 134 | Yellowish green |
| 62.48 | 1% | 200 | 50 | 0.479 | 206 | 0.351 | 0.594 | 518 | 68 | Green |

TABLE 10

Example of time resolved EL characteristics of a 1 EML color tunable OLED. Device structure is shown in FIG. 22.

| Time interval [us] | 1931 CIE x | 1931 CIE y | λ max [nm] | FWHM [nm] | Emission color |
|---|---|---|---|---|---|
| 0-0.33 | 0.413 | 0.521 | 630 | 178 | Green-Yellow |
| 0.5-0.9 | 0.470 | 0.490 | 630 | 154 | Yellow |
| 1.2-1.7 | 0.521 | 0.449 | 630 | 58 | Yellow |
| 2-2.4 | 0.537 | 0.436 | 632 | 64 | Orange |
| 2.5-3 | 0.541 | 0.433 | 634 | 68 | Orange |
| 4.4-4.8 | 0.543 | 0.431 | 636 | 70 | Red |
| 6-12 | 0.604 | 0.382 | 632 | 58 | Red |

*Momentary 10 V, 136 mA/cm$^2$, 10 kHz 6% duty factor

TABLE 11

Time resolved EL emission R/G peaks intensity of a pulse driven 1 EML color tunable OLED. Device structure is shown in FIG. 22.

| Part of the pulse | Time [us] From | Time [us] To | Integrated Intensity [a.u.] Red | Integrated Intensity [a.u.] Green | R/G Color peak ratio | Emission color |
|---|---|---|---|---|---|---|
| Rise | 0 | 2 | 56.6 | 24.2 | 2.34 | Green-Yellow |
| Steady | 2 | 4 | 143.2 | 47.2 | 3.03 | Orange |
| Steady | 4 | 6 | 148.6 | 48.2 | 3.08 | Orange |
| Decay | 6 | 12 | 83.0 | 9.1 | 9.11 | Red |

*Momentary 10 V, 136 mA/cm$^2$, 10 kHz 6% duty factor, R peak @ 620 nm, G peak @ 518 nm

TABLE 12

Example of R-Y color for a 1 EML color tunable OLED driven with different pulse width/frequency ratios. Integrated EL spectral data. Device structure is shown in FIG. 22.

| Driving conditions | | | | | | | | | |
|---|---|---|---|---|---|---|---|---|---|
| Duty factor | Frequency | Pulse width | Radiance | Luminance | 1931 CIE | | λ max | FWHM | Emission |
| [%] | [Hz] | [us] | [W/sr/m$^2$] | [cd/m$^2$] | x | Y | [nm] | [nm] | color |
| 0.35 | 10,000 | 0.35 | 1.177 | 228 | 0.585 | 0.397 | 626 | 48 | Red |
| 0.25 | 50 | 50 | 0.898 | 224 | 0.519 | 0.452 | 626 | 46 | Yellow |

*Momentary 8 V, 230 mA/cm$^2$

TABLE 13

Example of the luminance variation whilst maintaining a constant yellow color for a 1 EML color tunable OLED. Device structure is shown in FIG. 22.

| Driving conditions. Momentary 16 V, 752.9 mA/cm$^2$ | | | | | | | | | |
|---|---|---|---|---|---|---|---|---|---|
| Duty factor | Frequency | Pulse | Radiance | Luminance | 1931 CIE | | λ max | FWHM | Emission |
| [%] | [Hz] | Width [us] | [W/sr/m$^2$] | [cd/m$^2$] | x | y | [nm] | [nm] | color |
| 0.18 | 35 | 50 | 0.61 | 152 | 0.521 | 0.451 | 626 | 46 | Yellow |
| 2.50 | 500 | 50 | 8.67 | 2,164 | 0.520 | 0.452 | 624 | 46 | Yellow |
| 5.00 | 1000 | 50 | 17.62 | 4,396 | 0.519 | 0.452 | 626 | 46 | Yellow |
| 10.00 | 2000 | 50 | 36.25 | 9,058 | 0.519 | 0.452 | 626 | 46 | Yellow |

TABLE 14

Example of the luminance variation whilst maintaining a constant red color for a 1 EML color tunable OLED. Device structure is shown in FIG. 22.

| Driving conditions. Momentary 16 V 752.9 mA/cm$^2$ | | | | | | | | | |
|---|---|---|---|---|---|---|---|---|---|
| Duty factor | Frequency | Pulse | Radiance | Luminance | 1931 CIE | | λ max | FWHM | Emission |
| [%] | [kHz] | Width [us] | [W/sr/m$^2$] | [cd/m$^2$] | x | y | [nm] | [nm] | color |
| 0.04 | 1 | 0.35 | 0.10 | 20 | 0.586 | 0.397 | 626 | 48 | Red |
| 0.18 | 5 | 0.35 | 0.53 | 103 | 0.587 | 0.396 | 626 | 48 | Red |
| 0.70 | 20 | 0.35 | 2.18 | 426 | 0.588 | 0.396 | 626 | 48 | Red |
| 1.75 | 50 | 0.35 | 5.71 | 1,115 | 0.587 | 0.395 | 626 | 48 | Red |
| 3.50 | 100 | 0.35 | 12.19 | 2,385 | 0.587 | 0.396 | 626 | 48 | Red |
| 7.00 | 200 | 0.35 | 25.54 | 5,010 | 0.586 | 0.397 | 626 | 48 | Red |

TABLE 15

Example of the luminance variation whilst maintaining a constant yellow color for a 2 EML color tunable OLED. Device structure is shown in FIG. 18.

| Driving conditions | | | | | | | | | | | |
|---|---|---|---|---|---|---|---|---|---|---|---|
| Momentary | Momentary J | Duty | Frequency | Pulse Width | Radiance | Luminance | 1931 CIE | | ¯931 | FWHM | Emission |
| V [V] | [mA/cm2] | factor [%] | [kHz] | [us] | [W/sr/m$^2$] | [cd/m$^2$] | x | y | CIEe | [nm] | color |
| 4.5 | 0.3933 | 50 | 1 | 500 | 0.17 | 53 | 0.448 | 0.512 | 624 | 148 | Yellow |
| 4.5 | 0.3933 | 75 | 1 | 750 | 0.27 | 86 | 0.445 | 0.514 | 624 | 148 | Yellow |
| 4.5 | 0.3933 | 99 | 1 | 990 | 0.38 | 122 | 0.443 | 0.517 | 624 | 150 | Yellow |

TABLE 16

Example of the luminance variation whilst maintaining a constant green color for a 2 EML color tunable OLED. Device structure is shown in FIG. 18.

| Driving conditions | | | | | | | | | | | |
|---|---|---|---|---|---|---|---|---|---|---|---|
| Momentary V [V] | Momentary J [mA/cm2] | Duty factor [%] | Frequency [Hz] | Pulse Width [us] | Radiance [W/sr/m$^2$] | Luminance [cd/m$^2$] | 1931 CIE x | 1931 CIE y | CIEe | FWHM [nm] | Emission color |
| 8.2 | 61.77 | 1 | 100 | 100 | 0.52 | 225 | 0.350 | 0.596 | 518 | 68 | Green |
| 8.2 | 61.77 | 10 | 1k | 100 | 5.30 | 2,305 | 0.350 | 0.596 | 518 | 68 | Green |
| 8.2 | 61.77 | 50 | 5k | 100 | 27.39 | 11,930 | 0.350 | 0.596 | 518 | 68 | Green |
| 8.2 | 61.77 | 100 | 10k | 100 | 57.68 | 25,160 | 0.349 | 0.596 | 518 | 68 | Green |

EXPERIMENTAL

Figure 9:
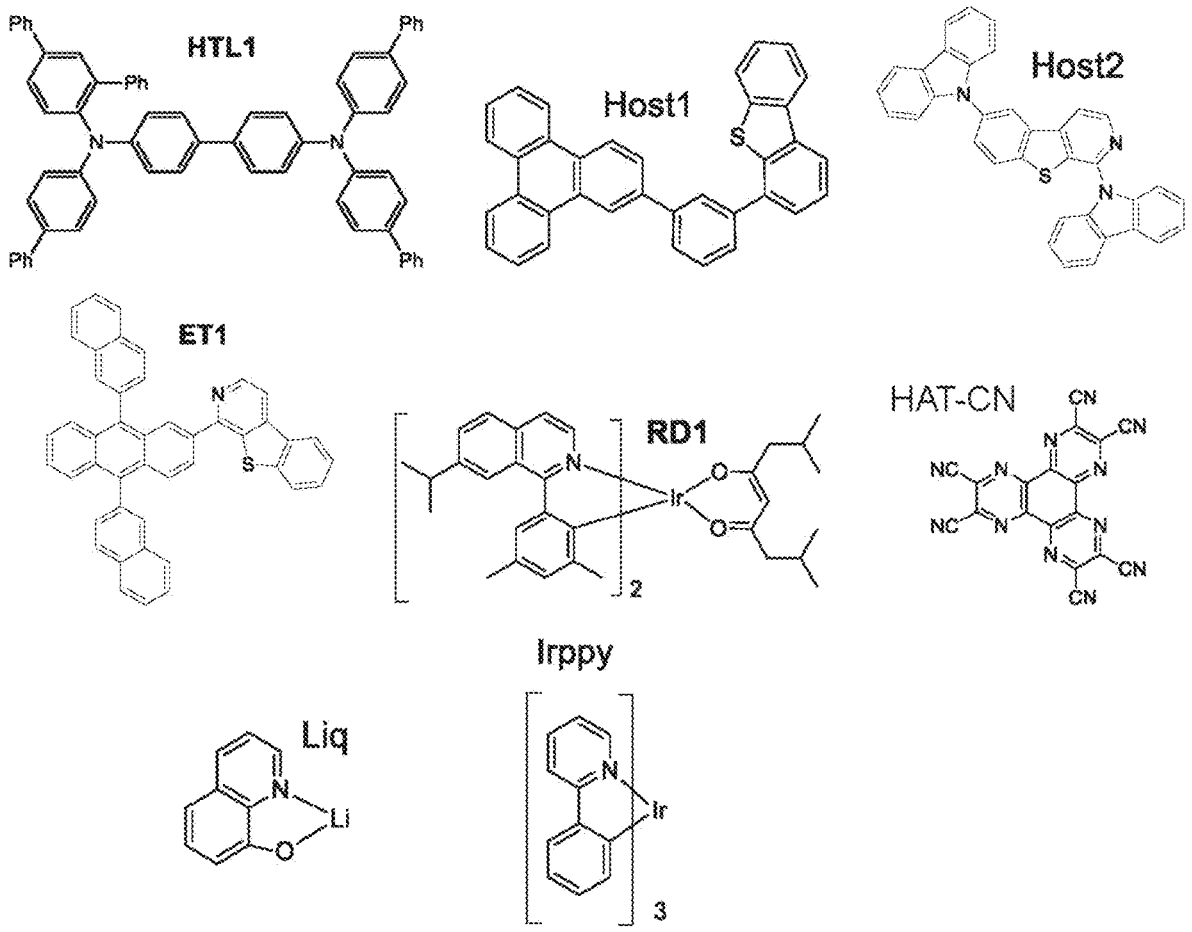
FIG. 9 shows chemical structures of example OLED materials suitable for use with embodiments disclosed herein.
Figure 12:
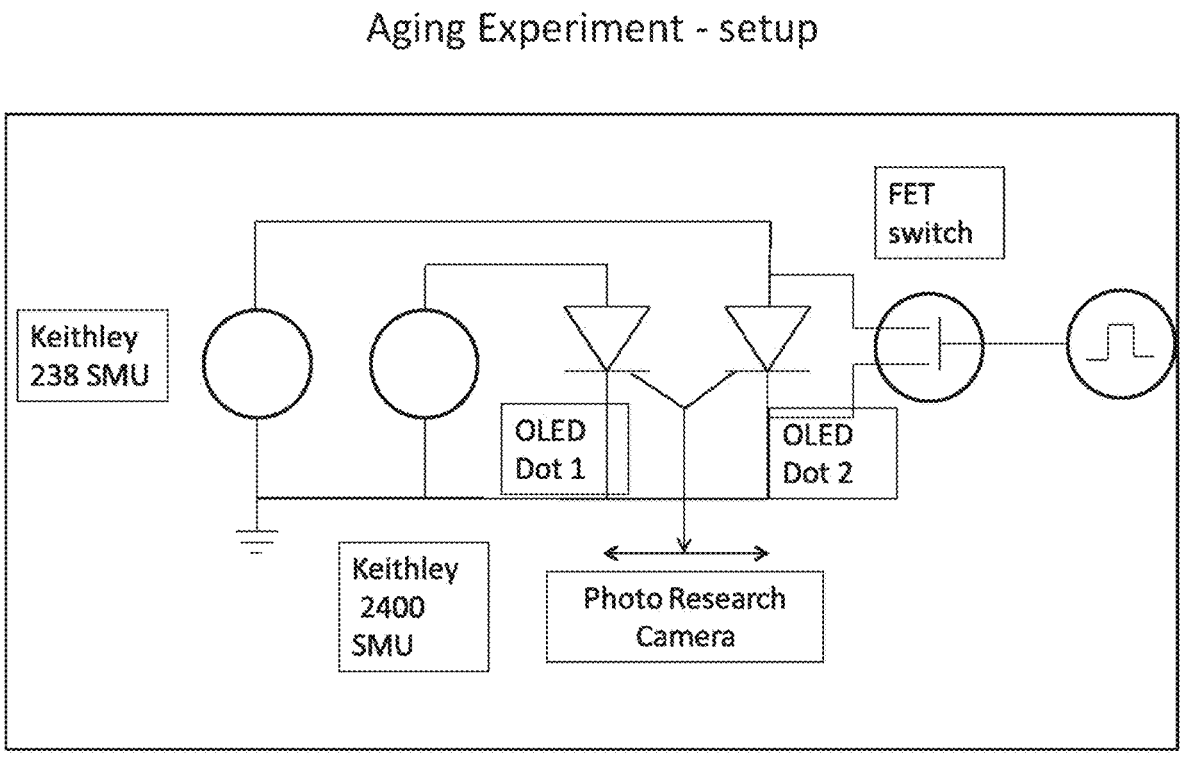
FIG. 12 shows an illustrative experimental setup for generating comparable aging curves for two devices operated under different driving conditions according to an embodiment.

The advantage of DC/pulse aging modes switch is demonstrated on 2 OLED dots of the same device structure driven in 2 different modes using the driving conditions described in Table 5. The example device structure used is: ITO(800 Å)/HAT-CN(100 Å)/HTL 1(450 Å)/Host2:Irppy 12%(300 Å)/Host2(50 Å)/Liq:ET 1 (40% 400 Å)/Liq(10 Å)/Al(1000 Å). FIG. 9 shows the chemical structures of the materials. The experimental setup to age the two dots simultaneously in DC and pulsed modes is shown in FIG. 12.

Dot 1 was driven at 10 mA/cm$^2$ for the first 115 hours and then switched to pulsed mode at 27 mA/cm$^2$ with a 37% duty factor. Dot 2 was driven in a pulsed mode of 27 mA/cm$^2$ with 37% duty factor for the first 115 hours and then switched to a 10 mA/cm$^2$ DC mode. Pulsed conditions were selected to provide the same integrated luminance as achieved at 10 mA/cm$^2$ DC mode of a non-aged device. The device driving schemes are shown in Table 5.

Figure 14:
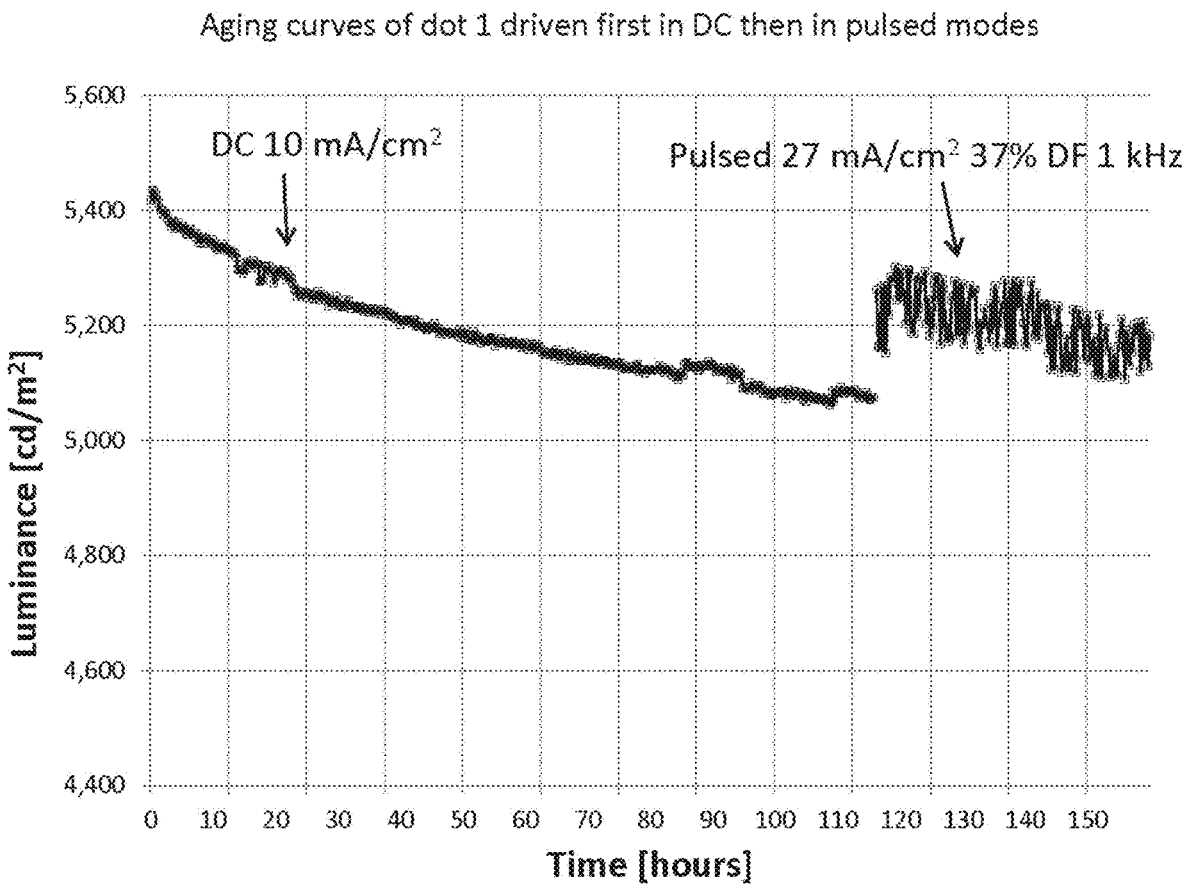
FIG. 14 shows the aging curves of an experimental device driven first in DC then in pulsed modes according to an embodiment.
Figure 15:
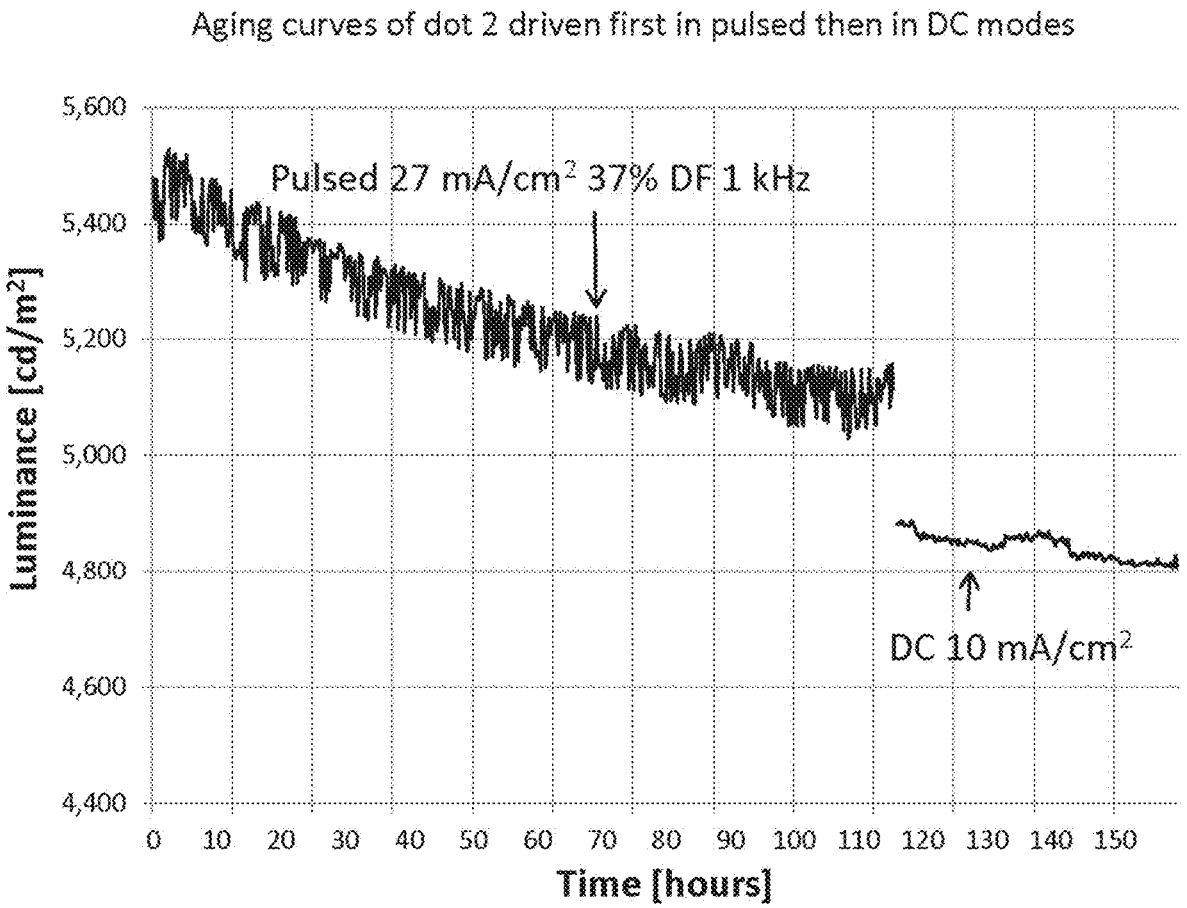
FIG. 15 shows the aging curves of an experimental device driven first in pulsed then in DC modes according to an embodiment.

FIG. 14 and Table 6 show the aging curves and device characteristics and aging levels of dot 1. It was found that switching from DC to pulsed mode provides additional luminance rise. For 115 hours of DC aging, the relative luminance became 93.4%. After switching to pulsed mode, the relative luminance became 95.9%, i.e. 2.5% of the aging was "eliminated" by switching from DC to pulsed mode.

The opposite effect of an additional loss of luminance (aging) was observed on dot 2 when the device was aged in the pulsed mode for 115 hours and then switched to DC mode, as shown in FIG. 15 and Table 6. In this case the dot 2 was aged 94.2% for 115 hours of pulsed driving, and the aging level became 89.9% when the driving mode was changed to the DC mode. Thus, it was found that 4.3% of the aging was "added" by changing from the pulsed mode to the DC mode.

FIG. 13 demonstrates the example of changes in luminous efficacy vs. J characteristics after aging the devices in DC and pulsed modes. Less luminance drop upon aging was observed when a device is driven in the high luminance range, and a greater luminance drop upon aging is observed when the device is driven in the low luminance range. The same phenomenon holds for both DC and pulsed aging modes.

FIG. 14 shows the aging curves of dot 1 driven first in DC then in pulsed modes. The device aged with constant current DC becomes brighter when switched to the pulse waveform with the original parameters generating the same Lo as the dc constant current, showing an additional gain in lifetime.

FIG. 15 shows the aging curves of dot 2 driven first in pulsed then in DC modes. As shown, the pulsed aged device loses luminance when the driving scheme is changed to the DC mode.

Figure 16:
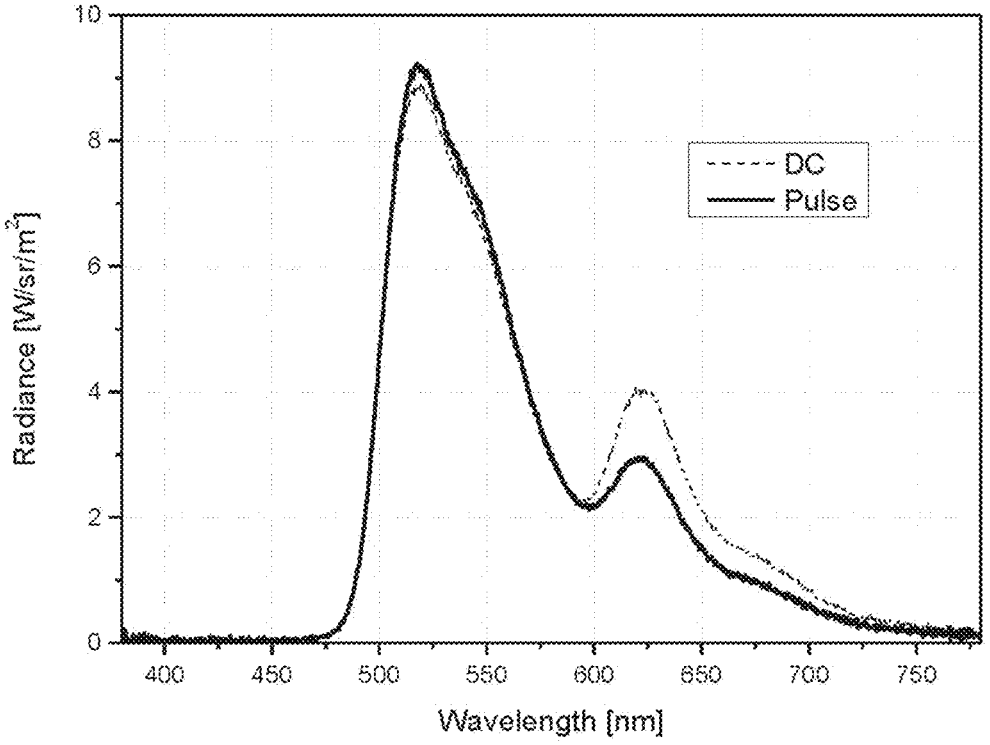
FIG. 16 shows example EL spectra of a green PHOLED with a 50 Å red probe component located at the ETL side of the EML, which shows the recombination profile shifting away from the red co-doped layer next to the ETL/EML interface under the pulsed driving according to an embodiment.

FIG. 16 shows the evidence of recombination profile changing in response to driving conditions. This is the same device structure as the prior example, except 50 Å of the EML in the proximity of the hole blocking layer has 1% of a red emitter so as to form a red probe layer. If the recombination zone in this device is next to the HTL interface, then the color of the devices is predominantly green; if recombination shifts closer to the ETL interface, then the color is predominantly red. So the spectrum of this device may indicate where the recombination zone is located in the device.

It is understood that the various embodiments described herein are by way of example only, and are not intended to limit the scope of the invention. For example, many of the materials and structures described herein may be substituted with other materials and structures without deviating from the spirit of the invention. The present invention as claimed may therefore include variations from the particular examples and preferred embodiments described herein, as will be apparent to one of skill in the art. It is understood that various theories as to why the invention works are not intended to be limiting.

We claim:

1. A method of operating an OLED display device, the method comprising:

receiving an input signal indicating an apparent luminance to be generated by at least one OLED in the display during a given frame time; and providing a first drive signal to the at least one OLED, the first drive signal comprising either a constant level to drive a constant luminance corresponding to the apparent luminance indicated by the input signal or a waveform specifying an output for the at least one OLED during the given frame time, wherein for the waveform the first drive signal produces a momentary luminance greater than the apparent luminance for at least a portion of the given frame time, the portion being less than a full given frame time, and wherein the constant level is provided until the OLED display device reaches a predetermined age, and thereafter the waveform is provided.

2. The method of claim 1, further comprising:

selecting the waveform from among a plurality of predefined waveforms.

3. The method of claim 2, wherein the plurality of predefined waveforms are stored by the device.

4. The method of claim 2, wherein the waveform is selected based upon an expected degradation of the at least one OLED.

5. The method of claim 2, wherein the waveform is selected based upon a factor selected from the group consisting of: the age of the at least one OLED, a measurement of an operating parameter of the at least one OLED, a known relationship of luminance efficacy to luminance of the at least one OLED, and a temperature of the at least one OLED.

6. The method of claim 2, wherein the waveform is selected to activate a selected region of an emissive layer within the at least one OLED.

7. The method of claim 1, wherein the first drive signal specifies a voltage or a current at which to drive the at least one OLED during the given frame time.

8. The method of claim 1, wherein a total integrated luminance resulting from the waveform during the given frame time is equivalent to a total integrated luminance of the apparent luminance over the given frame time.

9. The method of claim 1, wherein the given frame time is defined by a single frame of a video provided for display on the OLED display.

10. The method of claim 9, wherein the waveform is periodic and has a frequency greater than a frame frequency of the input signal.

11. The method of claim 1, wherein the first drive signal comprises a basic drive voltage applied concurrently with the waveform.

12. The method of claim 1, further comprising providing a second drive signal to the at least one OLED during a second frame time, wherein the second drive signal produces a momentary luminance equal to the apparent luminance.

13. A display device comprising:

at least one OLED;

a receiver configured to receive a display signal indicating an apparent luminance for the at least one OLED during a given frame time;

a drive circuit in signal communication with the at least one OLED and configured to provide a first drive signal to the at least one OLED, the first drive signal comprising either a constant level to drive a constant luminance corresponding to the apparent luminance indicated by the input signal or, a waveform specifying an output for the at least one OLED during the given frame time; and a processor configured to generate the waveform, wherein the waveform defines a momentary luminance during at least a portion of the given frame time that is greater than the apparent luminance, the portion being less than a full given frame time, wherein the drive circuit provides the constant level until the OLED display device reaches a predetermined age, and thereafter provides the waveform.

14. The device of claim 13, wherein the at least one OLED comprises a plurality of emissive layers, each separated from an adjacent emissive layer of the plurality of emissive layers by a blocking layer.

15. The device of claim 13, wherein the at least one OLED comprises an emissive region containing at least two regions, each region configured to emit light having a peak wavelength different than the other.

16. The device of claim 13, wherein the processor is configured to generate the waveform by selecting the waveform from among a plurality of predefined waveforms.

17. The device of claim 13, wherein a total integrated luminance resulting from the waveform during the given frame time is equivalent to a total integrated luminance of the apparent luminance over the given frame time.

18. The device of claim 13, wherein the given frame time is defined by a single frame of a video provided for display on the OLED display.

19. The device of claim 13, wherein the drive circuit is further configured to provide a second drive signal to the at least one OLED during a second frame time, wherein the second drive signal produces a momentary luminance equal to the apparent luminance.

20. The method of claim 2, wherein the waveform is selected to move a recombination profile to include less damaged areas of the device emissive layer.

* * * * *